US007498114B2

(12) United States Patent
Makino et al.

(10) Patent No.: US 7,498,114 B2
(45) Date of Patent: Mar. 3, 2009

(54) TONER, PROCESS OF MANUFACTURING TONER, DEVELOPER, TONER CONTAINER, PROCESS CARTRIDGE, IMAGE FORMING APPARATUS, AND IMAGE FORMING PROCESS

(75) Inventors: Nobuyasu Makino, Shizuoka (JP); Fumitoshi Murakami, Shizuoka (JP); Colin Weaver, Shropshire (GB); David Roberts, Shropshire (GB); Tsutomu Kagawa, Shropshire (GB)

(73) Assignees: Ricoh Company, Ltd., Tokyo (JP); Ricoh UK Products Ltd., Shropshire (GB)

( * ) Notice: Subject to any disclaimer, the term of this patent is extended or adjusted under 35 U.S.C. 154(b) by 330 days.

(21) Appl. No.: 10/953,382

(22) Filed: Sep. 30, 2004

(65) Prior Publication Data

US 2005/0112492 A1 May 26, 2005

(30) Foreign Application Priority Data

Oct. 1, 2003 (JP) ..... 2003-343327
Feb. 9, 2004 (JP) ..... 2004-031927

(51) Int. Cl.
*G03G 9/08* (2006.01)

(52) U.S. Cl. ..... 430/137.18; 430/137.1

(58) Field of Classification Search ..... 430/137.18, 430/137.1

See application file for complete search history.

(56) References Cited

U.S. PATENT DOCUMENTS 4,212,837 A 7/1980 Oguchi et al.
5,716,751 A * 2/1998 Bertrand et al. ..... 430/137.18
5,839,670 A * 11/1998 Omata et al. ..... 241/5
6,824,086 B1 * 11/2004 Mazurkiewicz et al. ..... 241/5
7,118,052 B2 * 10/2006 Zhou ..... 239/424
2001/0036586 A1 11/2001 Adachi et al.
2003/0224271 A1 * 12/2003 Teshima ..... 430/105
2005/0112492 A1 5/2005 Makino et al.
2006/0222980 A1 * 10/2006 Makino et al. ..... 430/105

FOREIGN PATENT DOCUMENTS

EP 0 568 724 A2 11/1993
EP 0 581 257 A1 2/1994
JP 59-120263 7/1984
JP 4-86673 3/1992
JP 2003-262981 9/2003
WO WO 02/089998 A1 11/2002

OTHER PUBLICATIONS

U.S. Appl. No. 11/385,994, filed Mar. 22, 2006, Makino et al.
U.S. Appl. No. 10/848,062, filed May 19, 2004, Fumitoshi Murakami et al.
U.S. Appl. No. 11/752,562, filed May 23, 2007, Kubota et al.

* cited by examiner

*Primary Examiner*—Hoa V Le
(74) *Attorney, Agent, or Firm*—Oblon, Spivak, McClelland, Maier & Neustadt, P.C.

(57) ABSTRACT

A toner manufacturing process, includes: melting a kneaded composition, to thereby obtain a melted composition; and spraying the melted composition with a high pressure gas, to thereby form a fine particle. The kneaded composition is selected from the group consisting of the following <1>, <2> and <3>: <1> a first kneaded composition including a binder resin, a colorant, and a charge controlling agent, <2> a second kneaded composition including a binder resin, a colorant, a charge controlling agent, and a releasing agent, and <3> a third kneaded composition including a binder resin, a magnetic agent, a charge controlling agent, and a releasing agent.

3 Claims, 17 Drawing Sheets

FIG. 16
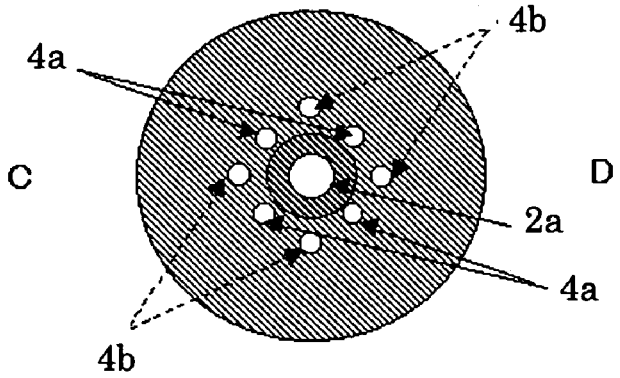
FIG. 17
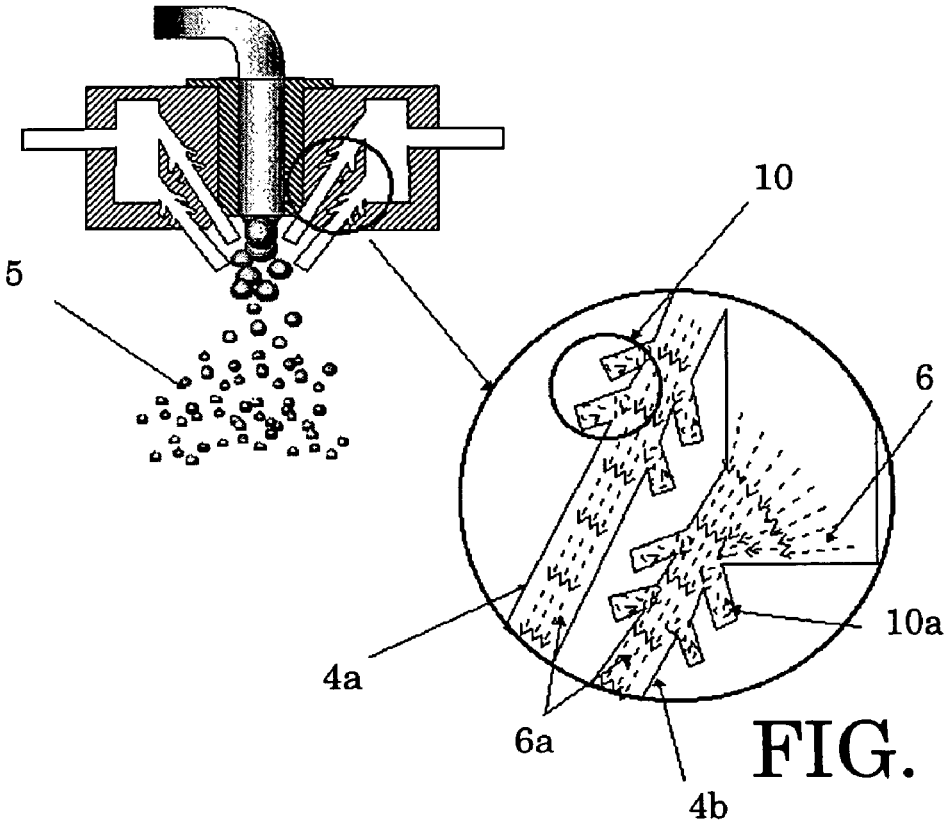
FIG. 17A

TONER, PROCESS OF MANUFACTURING TONER, DEVELOPER, TONER CONTAINER, PROCESS CARTRIDGE, IMAGE FORMING APPARATUS, AND IMAGE FORMING PROCESS

BACKGROUND OF THE INVENTION

1. Field of the Invention

The present invention relates to a toner which is preferably used for an electrophotography, an electrostatic recording process, an electrostatic printing process and the like. Moreover, the present invention relates to an effective process for manufacturing the toner. Furthermore, the present invention relates to a developer using the toner, a toner container, a process cartridge, an image forming apparatus, and an image forming process.

2. Description of the Related Art

In terms of the electrophotography, recently, with the digitization as well as the development of network and computer, a graphic copy printout (mainly using photographs) is increasing in addition to a conventional character copy printout.

Improvement in image quality by the electrophotography is more and more required, one measure therefor including toner's smaller sizing (namely, smaller diameter of toner particle).

For obtaining the above toner, a pulverizing process including a series of operations is conventionally used in which a plurality of materials constituting the toner are heated, melted and kneaded, and thereafter the thus obtained kneaded compositions are to be pulverized. Specifically, the above plurality of the materials include <1> a kneaded composition containing at least a binder resin, a colorant, and a charge controlling agent; <2> a kneaded composition containing at least a binder resin, a colorant, a charge controlling agent, and a releasing agent; <3> a kneaded composition containing at least a binder resin, a colorant, a charge controlling agent, a releasing agent, and a magnetic agent; and the like.

The above pulverizing process is, however, inconvenient due to its low energy efficiency which may be attributable to an increase in an energy spent on the pulverization, also due to increased fine particles in the pulverization. Moreover, the above pulverizing process may form angled particles and thereby decrease circularity of the particles, thus decreasing fluidity, supplying property, minor-dot reproducibility, which is also inconvenient.

For solving the above decreased circularity (due to the angled particles) and improving quality, a classifying operation is additionally carried out after the pulverization, so as to make a sharp distribution of particle diameters. In this case, however, product recovery may be decreased.

On the other hand, the image obtained in the electrophotography, recently, has been so improved in quality as to be comparable with that obtained in a silver salt photography. With this, it is required that graininess of the toner is in a range from 5 μm to 6 μm having a narrow distribution, which range is becoming a mainstream. The toner having the above graininess is more and more practical by a polymerizing process.

Compared with the conventional pulverizing process (including i. a kneading operation, ii. a pulverizing operation and a classifying operation, iii. a circulating mixing operation and a sieving operation), manufacturing the above polymerized toner is lower in carbon dioxide generation but higher in water consumption, bringing about an environmental protection issue and cost issue in water treatment. In terms of equipment, the above polymerized toner needs a huge plant, therefore, a mass production is necessary for reducing cost, increasing an initial capital investment.

The present inventors and others, for solving the above inconveniences, took a look at a spraying-granulating technology and studied it, which technology had not been conventionally proposed at all in the production of the electrophotographic toner.

As a spraying-granulating technology in the field other than the electrophotographic toner, the following technologies are proposed: i) A pamphlet of International Publication No. WO 02/089998 discloses a technology related to a production apparatus which is equipped with a supersonic gas spraying nozzle for spraying a liquid medium, so as to produce resin particles. ii) U.S. Pat. No. 4,575,325 discloses a technology using a spraying-granulating nozzle for producing metal particles by allowing a gas jet flow (causing an acoustic wave vibration with a toned frequency) to atomize melted metal. iii) U.S. Pat. No. 5,024,695 discloses a technology of atomizing melted metal in which a gas is dissolved by means of compressed air, to thereby produce metal particles or metal alloy particles having pores. U.S. Pat. No. 3,326,467 discloses an acoustic wave spraying nozzle for atomizing a fluid.

Any of the above conventional technologies, however, are for producing particles made of a single material, instead of a plurality of materials such as the electrophotographic toner, and therefore cannot be used, as they are, for the electrophotographic toner production. In other words, any of the above conventional technologies cannot solve the above production issues of the fine-particle toner, especially, productivity issue and energy consumption issue are yet to be solved.

Japanese Patent Application Laid-Open (JP-A) No. 1-182856, JP-A No. 9-146299 and JP-A No. 2000-19775 disclose the following technology: In melting and kneading a plurality of materials constituting the toner, i) a chemical foaming agent is added to the kneaded composition or ii) the chemical foaming agent is dispersed (inner dispersion) in advance in a binder resin, to be followed by adding thereto a temperature. Thereafter, a carbon gas or a nitrogen gas is to be caused for foaming the binder resin, to thereby form a cracked interface cracked by an inner bubble, thus improving a pulverizing efficiency at the next operation.

In the above processes, the chemical foaming agent used include i) inorganics such as hydrogen carbonate of an alkali metal (sodium, potassium, and the like), salt of carbon hydrogen of heavy metal (mercury, cadmium and the like); and ii) organics such as azide compound, azodi carbonamide, diamino benzene, flon 11, flon 12 and the like. Handling the above chemical foaming agents is dangerous, as the case may be, causing environmental pollution. Foaming the above chemical foaming agents may be in need of heating, applying a heat stress, especially, to a low temperature fixing toner which is attracting attention recently. Moreover, the above chemical foaming agents, as they are, may cause a harmful effect on the toner's properties such as physical property, fixing property, and chargeability.

Apart from the toner, JP-A No. 2003-10666 discloses a technology of suppressing discoloration and carbonization caused by heat deterioration at a kneading operation of a thermoplastic resin, so as to foam a binder resin for forming a foamed mold. Specifically, this technology injects and disperses a gasified carbon dioxide in the kneading operation, and thereby causes an inner foaming, thus forming a bubble.

Applying the technology of JP-A No. 2003-10666 to the production of the toner may use inactive gas, which may not cause a harmful effect on the toner's qualities. However, the air into the melted resin is likely to cause an uneven diffusion, thus the ratio of the bubble into the toner resin may become 60 volume % at highest. Summarizing the above, an effect given to the toner's pulverizing property at a latter operation (which effect is expected from the foaming) is intermediate at most, in other words, this effect is not sufficient for pulverizing the fine particles of the toner composition to about 5 μm to 6 μm.

The technology of JP-A No. 2003-10666 is, specifically, for the purpose of producing a foaming material and a foaming composition that have a small bubble by foaming a single polymer material. On the other hand, the toner is a composition containing the binder resin and other materials such as colorant and the like. The kneaded composition made of the plurality of the materials which composition prepared in the toner manufacturing operations is to be pulverized for producing the final object, that is, the toner, and therefore, cannot be used as it is for the electrophotographic toner. With this, the issues arising from the fine-particle toner production is yet to be solved, especially, the productivity issue and the energy consumption issue.

In the above conventional chemical foaming processes, enabling light weight of the foaming resin involves decreased strength, thus limiting usage as a molded part. Concerning this, JP-A No. 2000-19775 discloses a Micro Cellular Foaming (MCF) technology using a supercritical fluid developed by MIT (Massachusetts Institute of Technology). The above MCF technology enables production of a mold resin with minor bubbles (having particle diameter of 5 μm or less) foamed evenly. Moreover, Japanese Patent (JP-B) No. 2,625,576 discloses a technology of producing a foaming material and a foaming plastic composition which have a very small bubble.

Any of the above spraying-granulating technologies, however, are for the purpose of producing a particle that is made of a single material, instead of a plurality of materials as the toner, and therefore cannot be properly used, as they are, for the toner. In other words, the technology disclosed in JP-B No. 2,625,576 cannot be applied to the toner production.

As is disclosed in JP-B No. 2,625,576, forming of bubbles in the kneaded composition having a density of $10^9$/foaming material $cm^3$ or more and an average bubble diameter of 5 μm or less cannot improve drastically the pulverizing property, or cannot improve yield due to ultra-fine particles caused in the pulverization.

In terms of producing toner using a supercritical fluid, JP-A No. 2001-312098 discloses a technology of dissolving a binder resin composition in a supercriticality and then mixing and dispersing colorant compositions in the supercriticality. The above technology, however, does not use the supercriticality for the purpose of carrying out melting or kneading of the toner materials followed by a spraying-granulating with a high pressure.

To date, in the field of toner manufacturing technology, a granulating technology of injecting a supercritical fluid is not combined with a spraying-granulating technology, which combined technology is preferred to be provided as soon as possible.

OBJECTS AND ADVANTAGES

Firstly: It is an object of the present invention to provide a toner manufacturing process featuring especially high energy efficiency and high productivity which process having operations of i) melting a kneaded composition (used for a conventional toner manufacturing process including pulverization) made of toner composition materials and then ii) granulating into fine particles the thus melted kneaded composition by a spraying-granulating. It is another object of the present invention to provide a toner manufactured by the above toner manufacturing process, which toner is capable of forming an electrophotographic image that is so excellent as to be comparable with a silver salt image in fine-line reproducibility, gradation and the like. It is still another object of the present invention to provide a developer using the toner, a toner container, a process cartridge, an image forming apparatus, and an image forming process.

Secondly: It is an object of the present invention to provide a toner manufacturing process featuring, especially at a low temperature, high energy efficiency and high productivity which process having operations of i) melting, in a supercritical state of a foaming gas material, a kneaded composition (used for a conventional toner manufacturing process including pulverization) made of toner composition materials and then ii) granulating into fine particles the thus melted kneaded composition by a spraying-granulating. It is another object of the present invention to provide a toner manufactured by the above toner manufacturing process, which toner is capable of forming an electrophotographic image that is so excellent as to be comparable with a silver salt image in fine-line reproducibility, gradation and the like. It is still another object of the present invention to provide a developer using the toner, a toner container, a process cartridge, an image forming apparatus, and an image forming process.

SUMMARY OF THE INVENTION

Under the present invention, the toner manufacturing process according to its first aspect comprises a melting operation of melting a kneaded composition, to thereby obtain a melted composition; and a spraying operation of spraying the melted composition with a high pressure gas, to thereby form a fine particle, wherein the kneaded composition is selected from the group consisting of the following <1>, <2> and <3>:

<1> a first kneaded composition comprising a binder resin, a colorant, and a charge controlling agent, <2> a second kneaded composition comprising a binder resin, a colorant, a charge controlling agent, and a releasing agent, and <3> a third kneaded composition comprising a binder resin, a magnetic agent, a charge controlling agent, and a releasing agent.

Under the present invention, the toner manufacturing process according to its second aspect comprises a kneading operation of kneading a mixed composition, to thereby obtain a kneaded composition; and a spraying operation of spraying the kneaded composition with a high pressure gas, to thereby form a fine particle, wherein the mixed composition is selected from the group consisting of the following <1>, <2> and <3>:

<1> a first mixed composition comprising a binder resin, a colorant, and a charge controlling agent, <2> a second mixed composition comprising a binder resin, a colorant, a charge controlling agent, and a releasing agent, and <3> a third mixed composition comprising a binder resin, a magnetic agent, a charge controlling agent, and a releasing agent.

Under the present invention, the toner manufacturing process according to its third aspect comprises a melting operation of melting a binder resin; spraying operation of spraying the thus melted binder resin with a high pressure gas, to thereby form a fine particle of the binder resin; and a fixing operation of fixing a colorant and a charge controlling agent to a surface of the fine particle of the binder resin.

The toner manufacturing processes according to its first aspect, second aspect and third aspect melt the kneaded composition made of the toner constituent material, then carry out the fine granulation through the spraying-granulating, to thereby manufacture the toner having high energy efficiency and high productivity.

Under the present invention, the toner manufacturing process according to its fourth aspect comprises a melting operation of melting a kneaded composition, to thereby obtain a melted composition; a dispersing operation of dispersing the melted composition by injecting a supercritical fluid under an applied pressure; and a spraying operation of spraying the dispersed melted composition with a high pressure gas, to thereby form a fine particle, wherein the kneaded composition is selected from the group consisting of the following <1>, <2> and <3>:

<1> a first kneaded composition comprising a binder resin, a colorant, and a charge controlling agent, <2> a second kneaded composition comprising a binder resin, a colorant, a charge controlling agent, and a releasing agent, and <3> a third kneaded composition comprising a binder resin, a magnetic agent, a charge controlling agent, and a releasing agent.

Under the present invention, the toner manufacturing process according to its fifth aspect comprises a kneading operation of kneading a mixed composition by injecting a supercritical fluid under an applied pressure, to thereby obtain a kneaded composition; and a spraying operation of spraying the kneaded composition with a high pressure gas, to thereby form a fine particle, wherein the mixed composition is selected from the group consisting of the following <1>, <2> and <3>:

<1> a first mixed composition comprising a binder resin, a colorant, and a charge controlling agent, <2> a second mixed composition comprising a binder resin, a colorant, a charge controlling agent, and a releasing agent, and <3> a third mixed composition comprising a binder resin, a magnetic agent, a charge controlling agent, and a releasing agent.

Under the present invention, the toner manufacturing process according to its sixth aspect comprises a kneading operation of kneading a binder resin and a colorant by injecting a supercritical fluid under an applied pressure, to thereby obtain a kneaded composition; a spraying operation of spraying the kneaded composition with a high pressure gas, to thereby form a fine particle; and a fixing operation of fixing a charge controlling agent to a surface of the fine particle of the kneaded composition.

The toner manufacturing processes according to its fourth aspect, fifth aspect and sixth aspect melt the kneaded composition made of the toner constituent material in the supercritical state of the foaming gas material, then carry out the fine granulation through the spraying-granulating, to thereby manufacture the toner having high energy efficiency and high productivity especially at a low temperature.

The toner under the present invention is manufactured by the toner manufacturing process under the present invention. With this, carrying out the image forming with the electrophotography using the toner can obtain a visible high quality image that is so excellent as to be comparable with a silver salt image in fine line reproducibility, gradation and the like.

The developer under the present invention includes the toner under the present invention. With this, carrying out the image forming with the electrophotography using the developer can obtain a visible high quality image that is so excellent as to be comparable with a silver salt image in fine line reproducibility, gradation and the like.

The toner container under the present invention contains the toner under the present invention. With this, carrying out the image forming with the electrophotography using the toner contained in the toner container can obtain a visible high quality image that is so excellent as to be comparable with a silver salt image in fine line reproducibility, gradation and the like.

The process cartridge under the present invention has at least i) an electrostatic latent image bearing member, and ii) a developing unit configured to develop, by using the toner under the present invention, an electrostatic latent image formed on the electrostatic latent image bearing member, to thereby form a visible image. The process cartridge is detachably mounted to the image forming apparatus, and useful. Moreover, using the toner under the present invention, the process cartridge can obtain a visible high quality image that is so excellent as to be comparable with a silver salt image in fine line reproducibility, gradation and the like.

The image forming apparatus under the present invention has at least i) an electrostatic latent image bearing member, ii) an electrostatic latent image forming unit configured to form an electrostatic latent image on the electrostatic latent image bearing member, iii) a developing unit configured to develop, by using the toner under the present invention, the electrostatic latent image, to thereby form a visible image, iv) a transferring unit configured to transfer the visible image to a recording medium, and v) a fixing unit configured to fix an image transferred to the recording medium. In the image forming apparatus, the electrostatic latent image forming unit may form the electrostatic latent image on the electrostatic latent image bearing member, the transferring unit may transfer the visible image to the recording medium, the fixing unit may fix the image transferred to the recording medium. As a result, an electrophotographic image can be efficiently formed that is so excellent as to be comparable with a silver salt image in fine line reproducibility, gradation and the like.

The image forming process under the present invention has at least i) forming an electrostatic latent image on an electrostatic latent image bearing member, ii) developing, by using the toner under the present invention, the electrostatic latent image, to thereby form a visible image, iii) transferring the visible image to a recording medium, and iv) fixing an image transferred to the recording medium. In the above image forming process, the forming may form the electrostatic latent image on the electrostatic latent image bearing member, the transferring may transfer the visible image to the recording medium, the fixing may fix the image transferred to the recording medium. As a result, an electrophotographic image can be efficiently formed that is so excellent as to be comparable with a silver salt image in fine line reproducibility, gradation and the like.

BRIEF DESCRIPTION OF THE DRAWINGS

FIG. 16 is a cross sectional view of the high pressure nozzle 4 in a horizontal direction in FIG. 14.

FIG. 17 is a cross sectional view of the high pressure nozzle 4 in a vertical direction in FIG. 14, in which FIG. 17A is a partly enlarged view of a spray nozzle 4*a* and a spray nozzle 4*b*.

Figure 1:
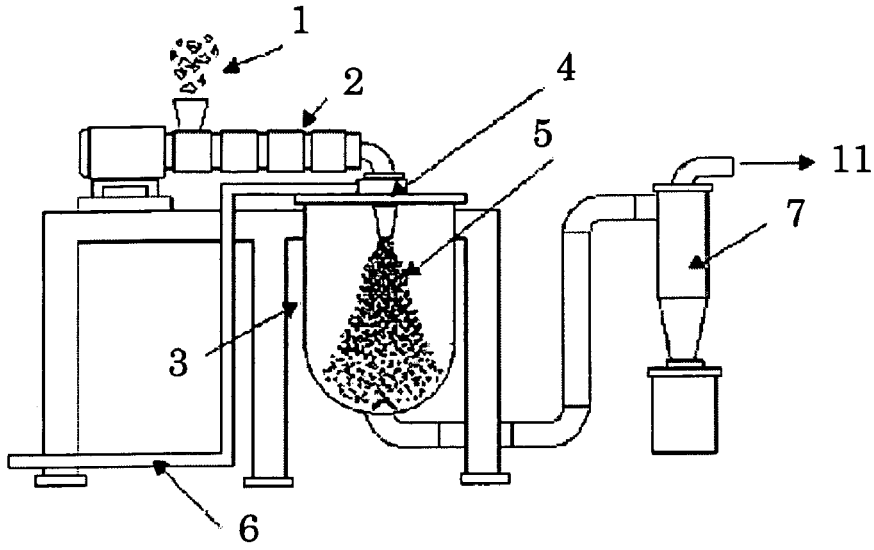
FIG. 1 shows an example of a spraying-granulating apparatus used for a spraying-granulating operation, according to a first embodiment under the present invention.

DESCRIPTION OF THE PREFERRED EMBODIMENTS (Toner and Toner Manufacturing Process)

Basically, a toner manufacturing process under the present invention focuses on a spraying-granulating technology (first embodiment) which was not conventionally proposed in manufacturing an electrophotographic toner. The toner manufacturing process under the present invention includes, as its applied technology, an improved successful combination (second embodiment) of i) a granulating technology which injects a supercritical fluid and ii) a spraying-granulating technology.

The toner manufacturing process of the first embodiment using the spraying-granulating under the present invention includes the following three:

Under the present invention, the toner manufacturing process according to its first aspect comprises a melting operation of melting a kneaded composition, to thereby obtain a melted composition; and a spraying operation of spraying the melted composition with a high pressure gas, to thereby form a fine particle, wherein the kneaded composition is selected from the group consisting of the following <1>, <2> and <3>:

<1> a first kneaded composition comprising a binder resin, a colorant, and a charge controlling agent, <2> a second kneaded composition comprising a binder resin, a colorant, a charge controlling agent, and a releasing agent, and <3> a third kneaded composition comprising a binder resin, a magnetic agent, a charge controlling agent, and a releasing agent.

Under the present invention, the toner manufacturing process according to its second aspect comprises a kneading operation of kneading a mixed composition, to thereby obtain a kneaded composition; and a spraying operation of spraying the kneaded composition with a high pressure gas, to thereby form a fine particle, wherein the mixed composition is selected from the group consisting of the following <1>, <2> and <3>:

<1> a first mixed composition comprising a binder resin, a colorant, and a charge controlling agent, <2> a second mixed composition comprising a binder resin, a colorant, a charge controlling agent, and a releasing agent, and <3> a third mixed composition comprising a binder resin, a magnetic agent, a charge controlling agent, and a releasing agent.

Under the present invention, the toner manufacturing process according to its third aspect comprises a melting operation of melting a binder resin; spraying operation of spraying the thus melted binder resin with a high pressure gas, to thereby form a fine particle of the binder resin; and a fixing operation of fixing a colorant and a charge controlling agent to a surface of the fine particle of the binder resin.

The toner manufacturing process of the second embodiment using the supercritical fluid spraying-granulating under the present invention includes the following three:

Under the present invention, the toner manufacturing process according to its fourth aspect comprises a melting operation of melting a kneaded composition, to thereby obtain a melted composition; a dispersing operation of dispersing the melted composition by injecting a supercritical fluid under an applied pressure; and a spraying operation of spraying the dispersed melted composition with a high pressure gas, to thereby form a fine particle, wherein the kneaded composition is selected from the group consisting of the following <1>, <2> and <3>:

<1> a first kneaded composition comprising a binder resin, a colorant, and a charge controlling agent, <2> a second kneaded composition comprising a binder resin, a colorant, a charge controlling agent, and a releasing agent, and <3> a third kneaded composition comprising a binder resin, a magnetic agent, a charge controlling agent, and a releasing agent.

Under the present invention, the toner manufacturing process according to its fifth aspect comprises a kneading operation of kneading a mixed composition by injecting a supercritical fluid under an applied pressure, to thereby obtain a kneaded composition; and a spraying operation of spraying the kneaded composition with a high pressure gas, to thereby form a fine particle, wherein the mixed composition is selected from the group consisting of the following <1>, <2> and <3>:

<1> a first mixed composition comprising a binder resin, a colorant, and a charge controlling agent, <2> a second mixed composition comprising a binder resin, a colorant, a charge controlling agent, and a releasing agent, and <3> a third mixed composition comprising a binder resin, a magnetic agent, a charge controlling agent, and a releasing agent.

Under the present invention, the toner manufacturing process according to its sixth aspect comprises a kneading operation of kneading a binder resin and a colorant by injecting a supercritical fluid under an applied pressure, to thereby obtain a kneaded composition; a spraying operation of spraying the kneaded composition with a high pressure gas, to thereby form a fine particle; and a fixing operation of fixing a charge controlling agent to a surface of the fine particle of the kneaded composition.

The toner under the present invention is obtained by the toner manufacturing process under the present invention.

With the description of the toner manufacturing process, details of the toner under the present invention are to be clarified.

First Embodiment

The toner manufacturing process using the spraying-granulating according to the first embodiment has the following three aspects.

The first aspect is, as described above, comprises a melting operation of melting a kneaded composition, to thereby obtain a melted composition; and a spraying operation of spraying the melted composition with a high pressure gas, to thereby form a fine particle, wherein the kneaded composition is selected from the group consisting of the following <1>, <2> and <3>:

<1> a first kneaded composition comprising a binder resin, a colorant, and a charge controlling agent, <2> a second kneaded composition comprising a binder resin, a colorant, a charge controlling agent, and a releasing agent, and <3> a third kneaded composition comprising a binder resin, a magnetic agent, a charge controlling agent, and a releasing agent.

Hereinabove, the melting is carried out, for example, with an extruder and the like.

FIG. 1 shows an example of a spraying-granulating apparatus used for a spraying-granulating operation, according to a first embodiment under the present invention.

In FIG. 1, a kneaded composition 1 preliminarily prepared is put in a melting unit 2 for melting. Then, a melted composition in the melting unit 2 is to be ejected into a chamber 3 via a high pressure nozzle 4, with a high pressure gas 6 from the high pressure nozzle 4 used for spraying the melted composition, to thereby obtain a sprayed-granulated composition 5.

The sprayed-granulated composition 5 is then diffused in the chamber 3 and cooled. With its surface tension attributable to the cooling, the sprayed-granulated composition 5 may become spherical, to thereby form a toner.

Figure 5:
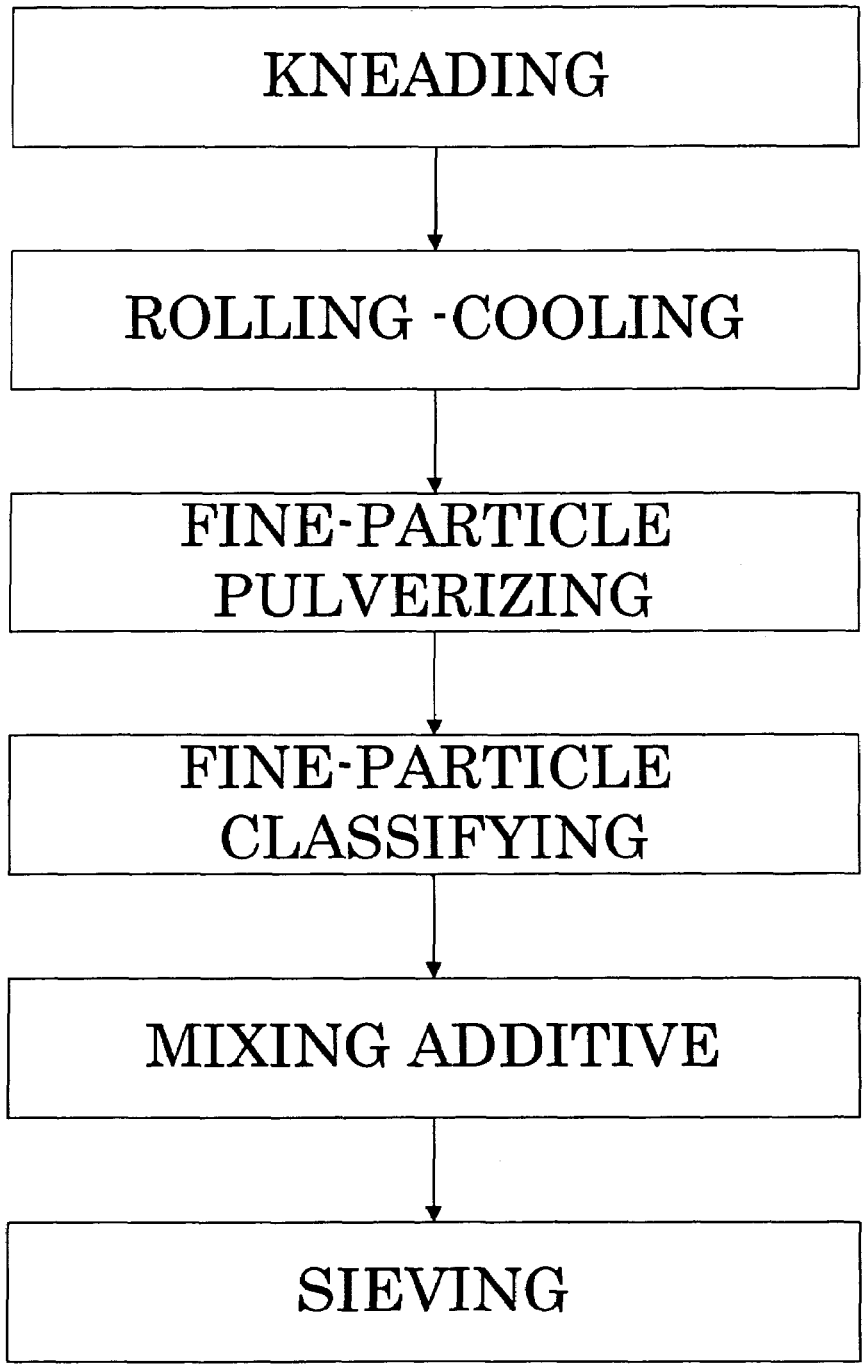
FIG. 5 RELATED ART
FIG. 5 shows a toner manufacturing operation, according to a related art.
Figure 6:
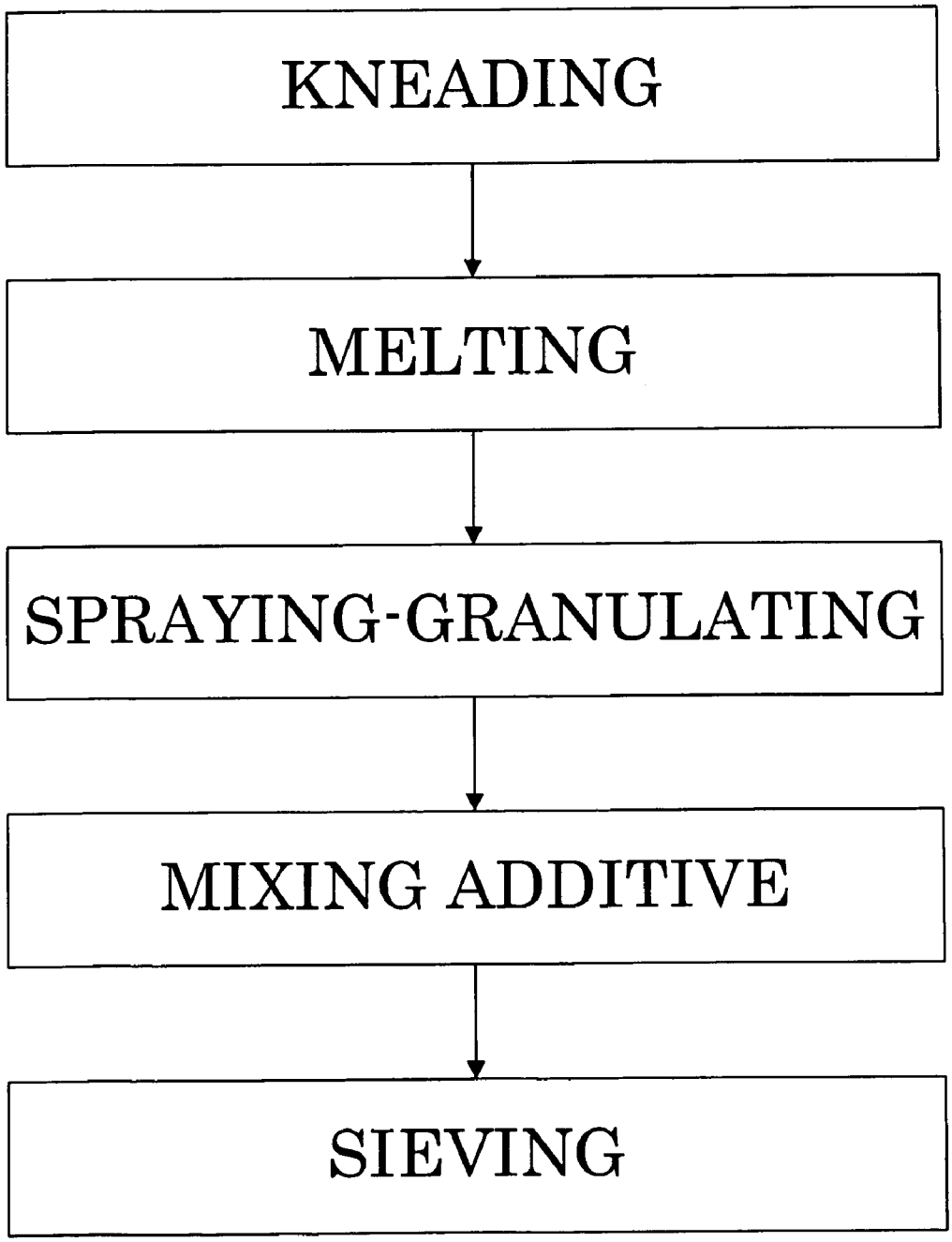
FIG. 6 shows a flow chart of an example of a toner manufacturing operation based on FIG. 1, according to the first embodiment under the present invention.

FIG. 5 shows a toner manufacturing operation, according to a related art. FIG. 6 shows a flow chart of an example of a toner manufacturing operation based on FIG. 1, according to the first embodiment under the present invention. Compared with the conventional kneading operation and fine-particle pulverizing operation in FIG. 5, the first embodiment under the present invention in FIG. 6 directly granulating the melted composition can bringing about higher productivity and lower energy consumption, leading to production of a toner having higher circularity and smaller particle diameter.

The second aspect is, as described above, comprises a kneading operation of kneading a mixed composition, to thereby obtain a kneaded composition; and a spraying operation of spraying the kneaded composition with a high pressure gas, to thereby form a fine particle, wherein the mixed composition is selected from the group consisting of the following <1>, <2> and <3>:

<1> a first mixed composition comprising a binder resin, a colorant, and a charge controlling agent, <2> a second mixed composition comprising a binder resin, a colorant, a charge controlling agent, and a releasing agent, and <3> a third mixed composition comprising a binder resin, a magnetic agent, a charge controlling agent, and a releasing agent.

Hereinabove, spraying is carried out with the projected high pressure gas.

Depending on the toner material's property and the required toner quality, the first aspect and the second aspect are to be distinguished. Specifically, the second aspect is preferred for the toner material that is likely to be dispersed, while the first aspect is preferred for the toner material that is unlikely to be dispersed.

Figure 2:
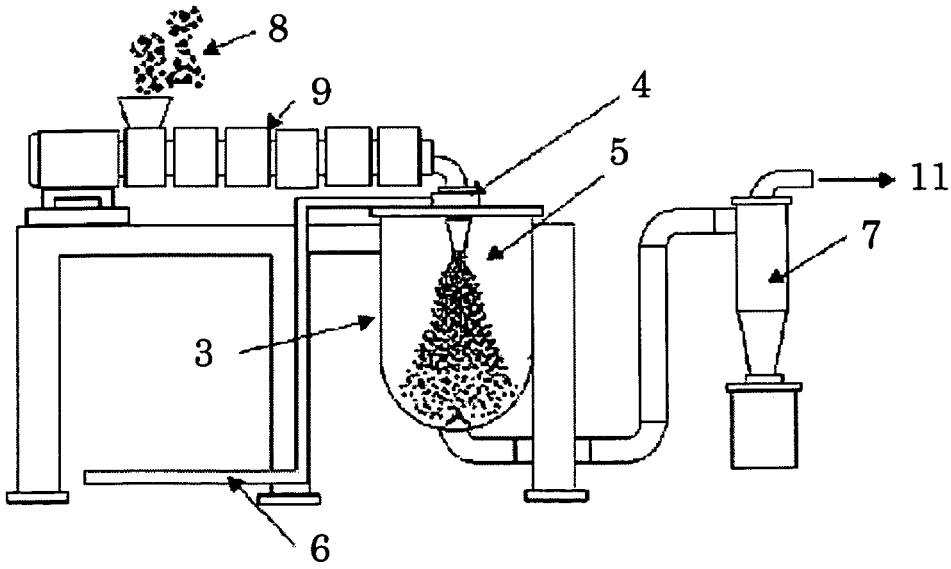
FIG. 2 shows another example of the spraying-granulating apparatus used for the spraying-granulating operation, according to the first embodiment under the present invention.

FIG. 2 shows another example of the spraying-granulating apparatus used for the spraying-granulating operation, according to the first embodiment under the present invention.

After being put in the kneading unit 9 (or an extruder), the mixed composition 8 may generate a self heat (exothermic) and the like due to a high viscosity at a point in time when dispersion and shear are started with the kneading. The above self heat temperature may become gradually lower with the proceeding kneading and thereby decrease the viscosity. At a point in time for completing the kneading, the mixed composition 8 may be in a melted state like the one in the first aspect, to be sprayed with the high pressure gas 6 from the high pressure nozzle 4 to thereby obtain the sprayed-granulated composition 5.

The sprayed-granulated composition 5 is then diffused in the chamber 3 and cooled. With its surface tension attributable to the cooling, the sprayed-granulated composition 5 may become spherical, to thereby form a toner.

Figure 7:
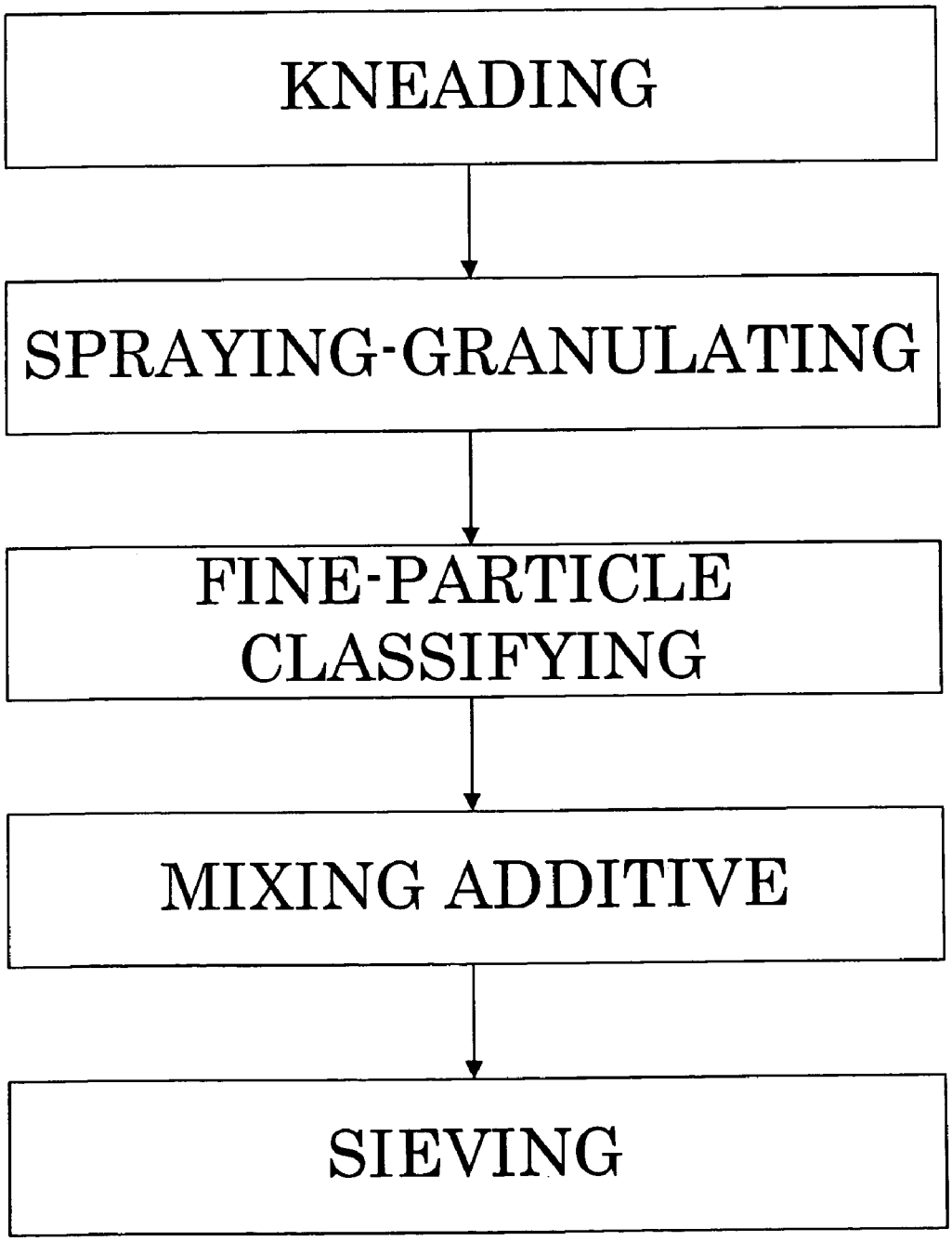
FIG. 7 shows a flow chart of another example of the toner manufacturing operation based on FIG. 2, according to the first embodiment under the present invention.

FIG. 7 shows a flow chart of another example of the toner manufacturing operation based on FIG. 2, according to the first embodiment under the present invention. Compared with the conventional kneading operation and fine-particle pulverizing operation in FIG. 5, the first embodiment under the present invention in FIG. 7 directly granulating the kneaded composition can bringing about higher productivity and lower energy consumption, leading to production of a toner having higher circularity and smaller particle diameter.

The third aspect is, as described above, comprises a melting operation of melting a binder resin for an electrophotography; spraying operation of spraying the thus melted binder resin with a high pressure gas, to thereby form a fine particle of the binder resin; and a fixing operation of fixing a colorant and a charge controlling agent to a surface of the fine particle of the binder resin.

Hereinabove, the fixing is carried out, for example, with mixer and the like.

Figure 8:
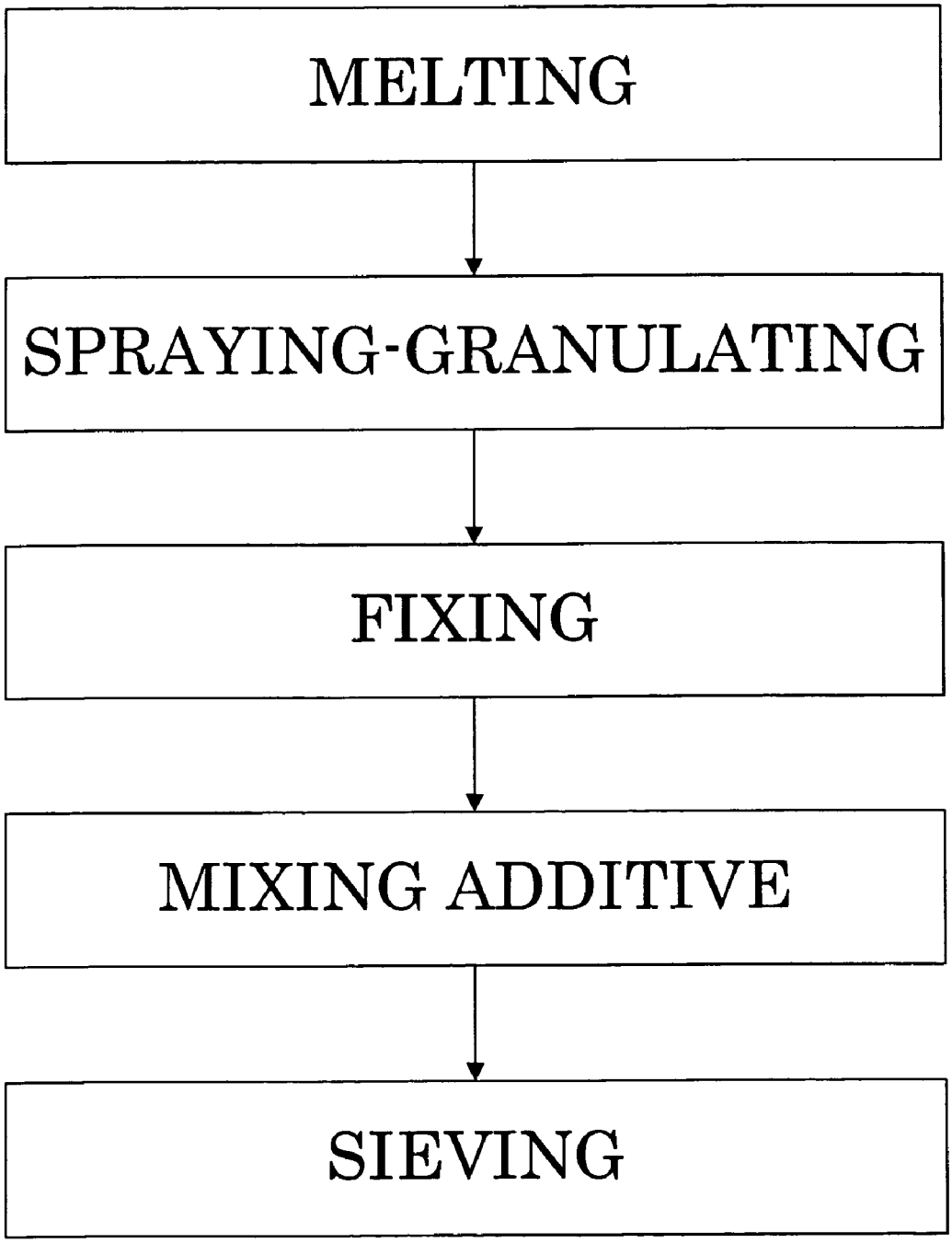
FIG. 8 shows a flow chart of still another example of the toner manufacturing operation based on FIG. 2, according to the first embodiment under the present invention.

FIG. 8 shows a flow chart of still another example of the toner manufacturing operation (including spraying-granulating) based on FIG. 2, according to the first embodiment (third aspect) under the present invention.

Using the spraying-granulating apparatuses in FIG. 2, the binder resin is put in the kneading unit 9 for melting. Then, the melted binder resin ejected from the kneading unit 9 is sprayed with the high pressure gas 6 from the high pressure nozzle 4 in the chamber 3. The thus sprayed melted binder resin is then diffused in the chamber 3 and cooled. With its surface tension attributable to the cooling, the sprayed melted binder resin may become spherical, to thereby form a sprayed-granulated composition 5 (in this case, resin).

Fixing the colorant and the charge controlling agent to the surface of the thus granulated binder resin using the mixer and the like can prepare the toner.

Compared with the conventional pulverizing process, the third aspect under the present invention can bring about the toner that has higher circularity and smaller diameter at a low temperature and with a low energy consumption.

Figure 9:
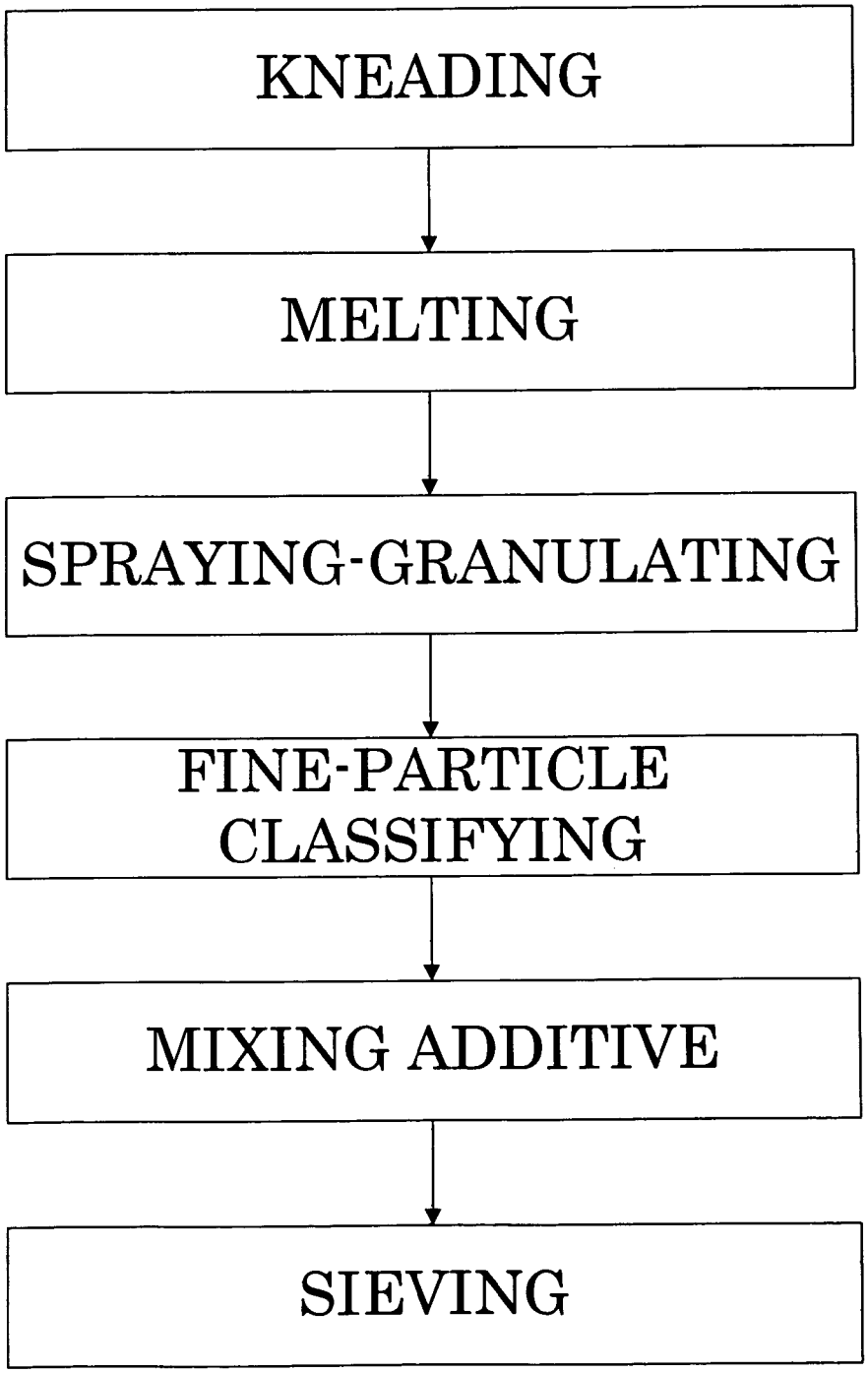
FIG. 9 shows a flow chart of an example of the toner manufacturing operation added by a classifying operation, according to the first embodiment under the present invention.

FIG. 9 shows a flow chart of an example of the toner manufacturing operation added by a classifying operation (for even particle distribution), according to the first embodiment under the present invention. Making the even distribution of the particles can stabilize the toner's chargeability, thus further improving resolution, image density and graininess.

Further description is made of the kneading or the melting of the sprayed-granulated toner or the sprayed-granulated binder resin, in the toner manufacturing process according to its first aspect to third aspect. Adding an organic solvent for the spraying to thereby obtain the sprayed-granulated composition is preferable for the following reason: The sprayed-granulated composition diffused and cooled in the chamber 3 may become spherical with its surface tension attributable to the cooling. In the above sphericity forming, a difference between the cooling speed of the thermoplastic resin and the gasifying speed of the organic solvent may form an irregularity on a surface of the spherical particle.

Addition of the organic solvent is preferably 0.5 weight % to 5.0 weight %, more preferably 1.0 weight % to 3.0 weight %.

Described below is stabilization of the particle property among the toner's spraying-granulating conditions, in the toner manufacturing process according to its first aspect to third aspect. The kneading temperature or the melting temperature is preferably not too low or not too high compared with an outflow starting temperature of the toner or of the binder resin. Too low a temperature may cause a fibrous particle, while too high a temperature may carbonize the material thus losing toner's property.

In sum, a proper temperature is preferably −30° C. to +80° C. relative to the toner's outflow starting temperature, more preferably −10° C. to +50° C. relative to the same.

Of the toner's spraying-granulating conditions, the kneading temperature or the melting temperature cannot be too low or too high compared with the glass transition temperature of the toner or the glass transition temperature of the binder resin, so as to obtain an even graininess.

The kneading temperature or the melting temperature becoming too low may combine a fine particle with a fibrous particle that are not needed for the electrophotographic sprayed-granulated toner, while becoming too high may decrease the surface tension at the cooling thus losing the circularity of the particle.

In sum, a proper temperature is preferably +10° C. to +100° C. relative to the glass transition temperature, more preferably +20° C. to +80° C. relative to the same.

Of the toner's spraying-granulating conditions, the kneading viscosity or the melting viscosity cannot be too low or too high, so as to obtain an even graininess. The kneading viscosity or the melting viscosity becoming too low may cause a fine particle that is not needed for the electrophotographic sprayed-granulated toner, while becoming too high may increase coarse particles.

In sum, a proper viscosity is preferably 1 Pa·s to 400 Pa·s, more preferably 40 Pa·s to 200 Pa·s.

Second Embodiment

Figure 3:
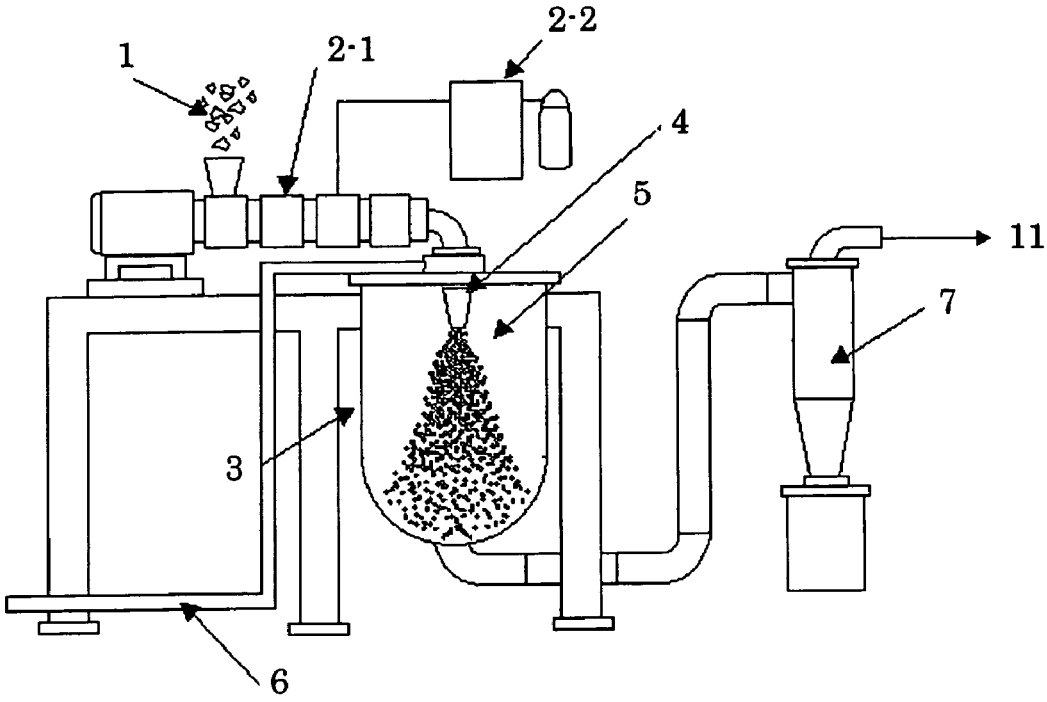
FIG. 3 shows an example of a spraying-granulating apparatus used for a spraying-granulating operation, according to a second embodiment under the present invention.

FIG. 3 shows a schematic of an example of the toner manufacturing process by the spraying-granulating of the second embodiment under the present invention, using supercritical fluid. In other words, the second embodiment is added by the use of the supercritical fluid to the first embodiment. Herein, the first aspect corresponds to the fourth aspect, the second aspect corresponds to the fifth aspect, the third aspect corresponds to the sixth aspect.

In FIG. 3, a kneaded composition 1 preliminarily prepared is put in a melting unit 2-1 for melting, then in the melting, is added by a supercritical fluid that is generated with a supercritical fluid generator 2-2. Then, a melted composition (containing the supercritical fluid) in the melting unit 2-1 is to be ejected into a chamber 3 via a high pressure nozzle 4, with a high pressure gas 6 from the high pressure nozzle 4 used for spraying the melted composition, to thereby obtain a sprayed-granulated composition 5.

The sprayed-granulated composition 5 is then diffused in the chamber 3 and cooled. With its surface tension attributable to the cooling, the sprayed-granulated composition 5 may become spherical, to thereby form a toner.

Figure 10:
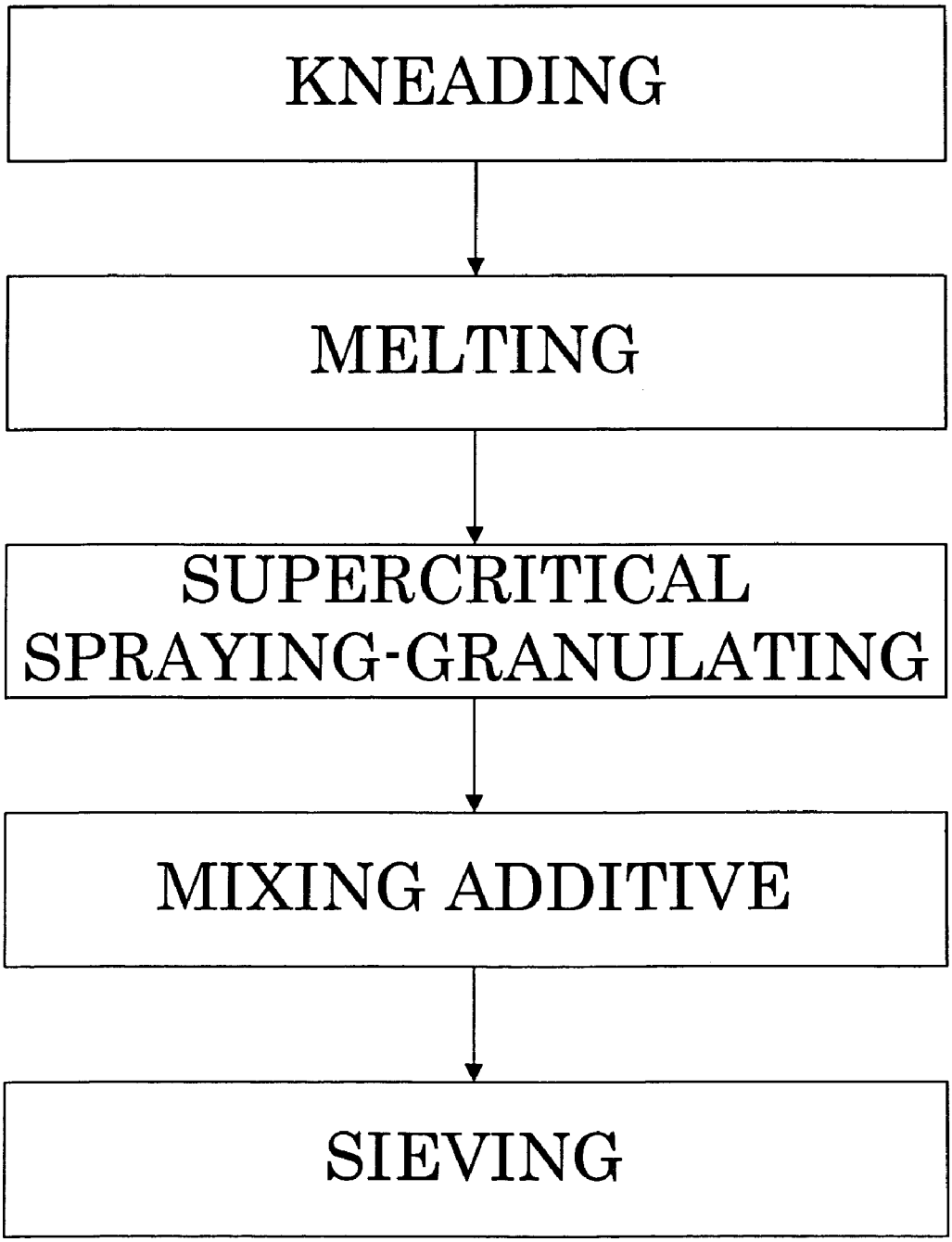
FIG. 10 shows a flow chart of an example of a toner manufacturing operation based on FIG. 1, according to the second embodiment under the present invention.

FIG. 10 shows flow chart of an example of a toner manufacturing operation based on FIG. 1, according to the second embodiment under the present invention.

Compared with the toner manufacturing in FIG. 5 showing the conventional kneading operation and pulverizing operation, the toner manufacturing in FIG. 10 can carry out a supercritical fluid fusion of the melted composition and a direct granulation, thus bringing about higher productivity and lower energy consumption, leading to production of a toner having higher circularity and smaller particle diameter. Compared with the toner manufacturing in FIG. 6 showing the first embodiment under the present invention, the toner manufacturing in FIG. 10 carrying out the supercritical fluid fusion can carry out the granulation at a low melting temperature, thus bringing about higher productivity and lower energy consumption, leading to production of the toner having higher circularity and smaller particle diameter.

The fifth aspect of the toner manufacturing process as the supercritical fluid spraying-granulating under the present invention may preliminarily prepare a mixed composition 8 selected from the group consisting of the following i), ii) and iii): i) a first mixed composition 8 made of at least a binder resin, a colorant, a charge controlling agent; ii) a second mixed composition 8 made of at least a binder resin, a colorant, a charge controlling agent, and a releasing agent; and iii) a third mixed composition 8 made of at least a binder resin, a magnetic agent, a charge controlling agent, and a releasing agent. Then, the fifth aspect may knead the above mixed composition 8, followed by a supercritical fluid fusion and a subsequent spraying of a projected high pressure gas 6, to thereby form a fine particle.

Depending on the toner material's property and the required toner quality, the fourth aspect and the fifth aspect are to be distinguished. Specifically, the fifth aspect is preferred for the toner material that is likely to be dispersed, while the fourth aspect is preferred for the toner material that is unlikely to be dispersed.

Figure 4:
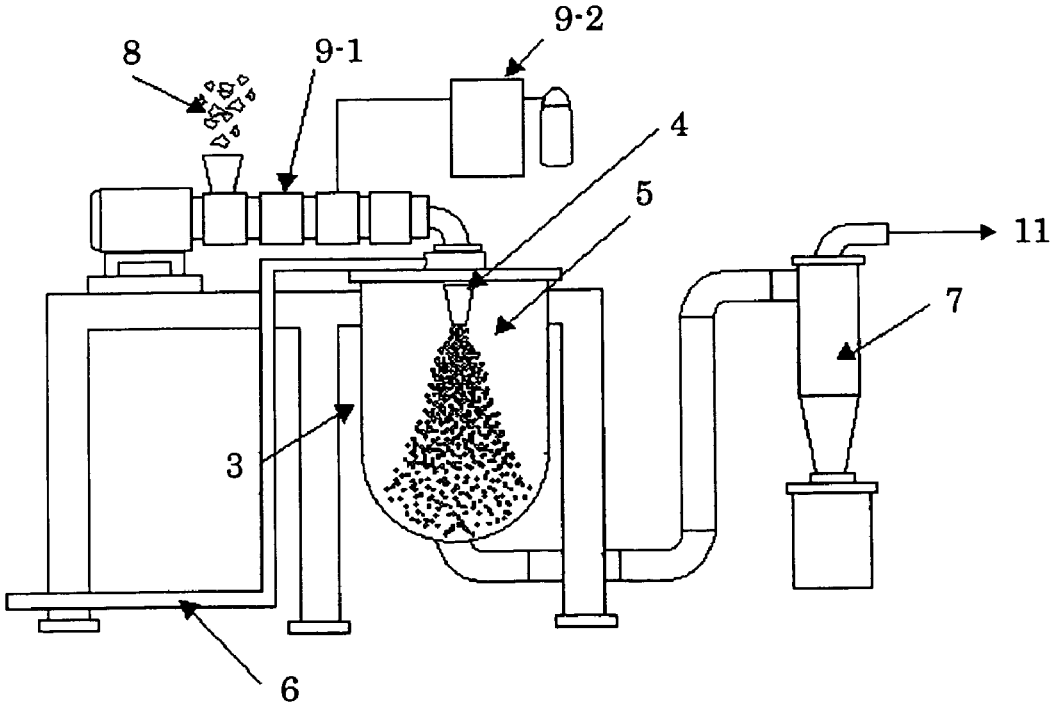
FIG. 4 shows another example of the spraying-granulating apparatus used for the spraying-granulating, according to the second embodiment under the present invention.

FIG. 4 shows another example of the spraying-granulating apparatus used for the spraying-granulating including the supercritical fluid spraying-granulating, according to the second embodiment under the present invention.

The mixed composition 8 is put in a kneading unit 9-1 for kneading, then in the kneading, is fused with a supercritical fluid that is generated with a supercritical fluid generator 9-2. Then, the thus kneaded composition in the kneading unit 9-1 is to be ejected into the chamber 3 via the high pressure nozzle 4 (which mainly injects a gas), with the high pressure gas 6 from the high pressure nozzle 4 used for spraying the melted composition, to thereby obtain the sprayed-granulated composition 5.

After being put in the kneading unit 9-1 (or an extruder), the mixed composition 8 may generate a self heat (exothermic) and the like due to a high viscosity at a point in time when dispersion and shear are started with the kneading. The above self heat temperature may become gradually lower with the proceeding kneading and thereby decrease the viscosity. At a point in time for completing the kneading, the mixed composition 8 may be in a melted state like the one in the first aspect, to be sprayed with the high pressure gas 6 from the high pressure nozzle 4 to thereby obtain the sprayed-granulated composition 5.

The sprayed-granulated composition 5 is then diffused in the chamber 3 and cooled. With its surface tension attributable to the cooling, the sprayed-granulated composition 5 may become spherical, to thereby form a toner.

Figure 11:
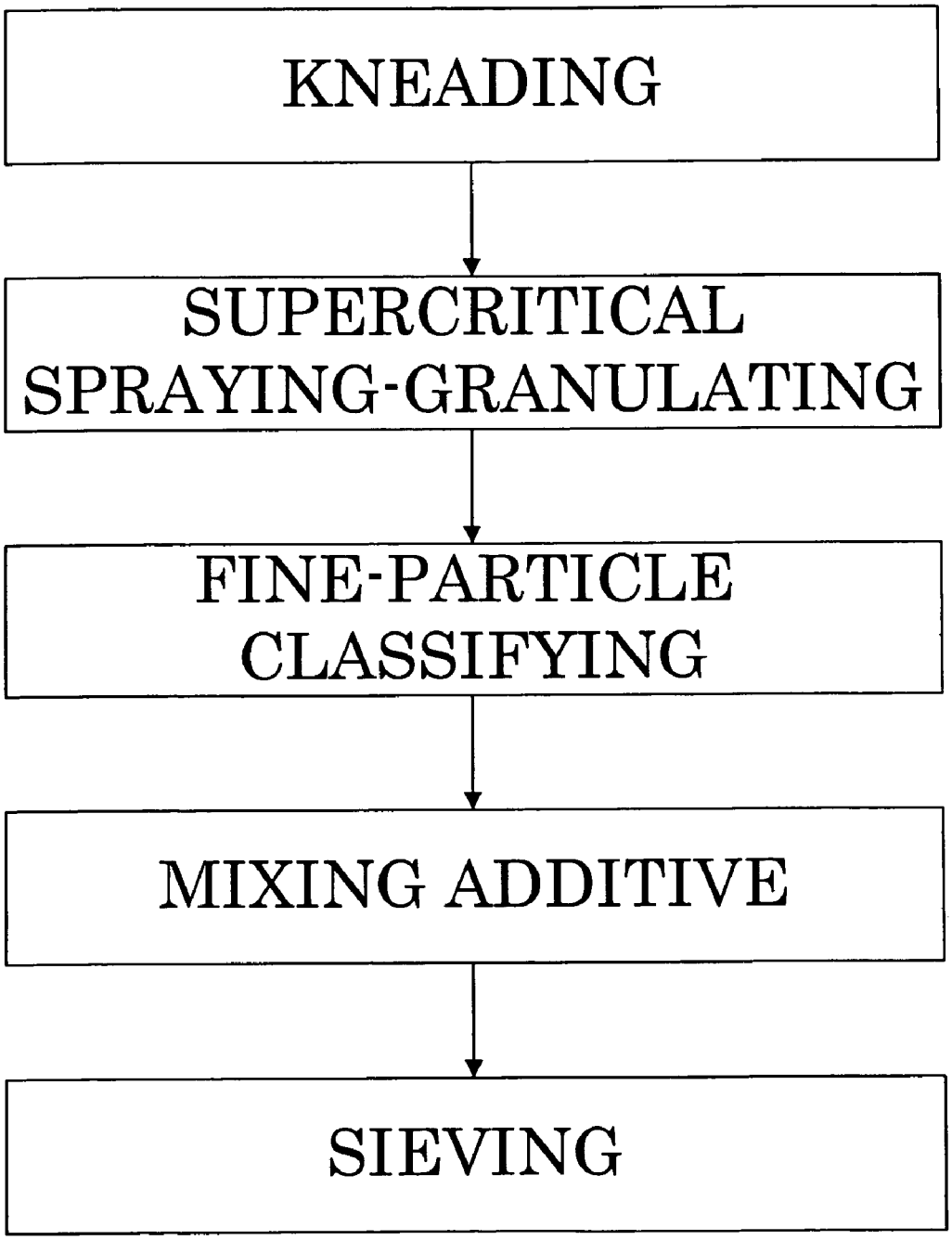
FIG. 11 shows a flow chart of an example of the toner manufacturing operation added by a classifying operation based on FIG. 4, according to the second embodiment under the present invention.

FIG. 11 shows a flow chart of an example of the toner manufacturing operation including a supercritical fluid spraying-granulating operation added by a classifying operation, based on FIG. 4, according to the second embodiment under the present invention. Compared with the toner manufacturing in FIG. 5 showing the conventional kneading operation and pulverizing operation, the toner manufacturing in FIG. 11 can carry out a supercritical fluid fusion of the kneaded composition for direct granulation, thus bringing about the toner having higher circularity and smaller particle diameter at a low temperature and with a low energy consumption.

The sixth aspect of the toner manufacturing process as the supercritical fluid spraying-granulating under the present invention may, as described above, melt the electrophotographic binder resin, spray the high pressure gas 6 for fine granulation, followed by fixing the colorant and the charge controlling agent to the surface of the binder resin using a mixer and the like.

Figure 12:
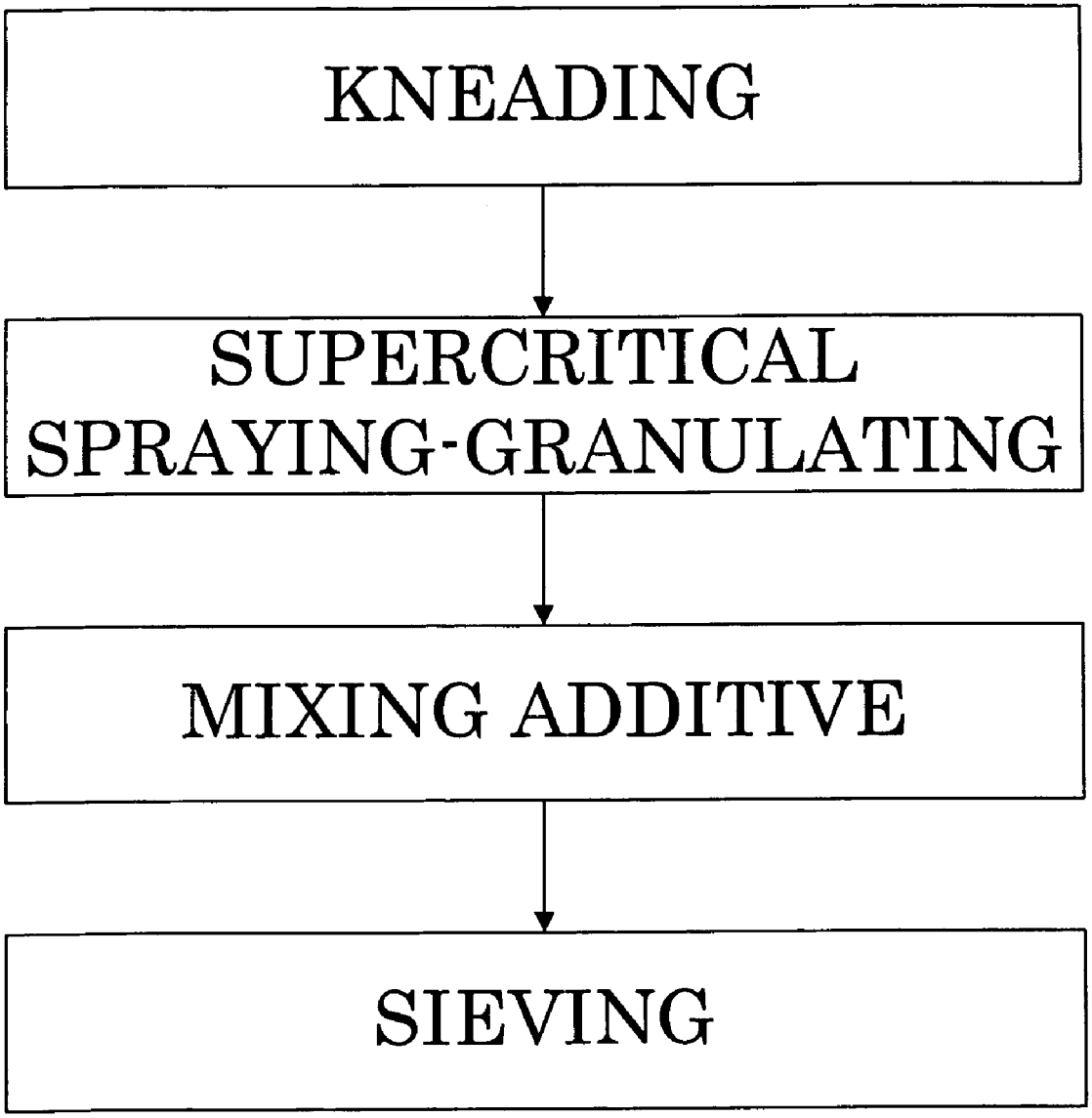
FIG. 12 shows a flow chart of another example of a toner manufacturing operation based on FIG. 4, according to the second embodiment under the present invention.

FIG. 12 shows a flow chart of the toner manufacturing operation according to the sixth aspect, based on the schematic in FIG. 4, by the supercritical fluid spraying-granulating under the present invention.

Using the apparatuses in FIG. 4, the binder resin is put in the kneading unit 9-1 for melting. Then, the melted binder resin ejected from the kneading unit 9-1 is sprayed with the high pressure gas 6 from the high pressure nozzle 4 in the chamber 3. The thus sprayed melted binder resin is then diffused in the chamber 3 and cooled. With its surface tension attributable to the cooling, the sprayed melted binder resin may become spherical, to thereby form a sprayed-granulated composition 5 (in this case, resin).

Fixing the colorant and the charge controlling agent to the surface of the thus granulated binder resin using the mixer and the like can prepare the toner.

Compared with the conventional pulverizing process, the sixth aspect under the present invention can bring about the toner that has higher circularity and smaller diameter at a low temperature and with a low energy consumption.

Figure 13:
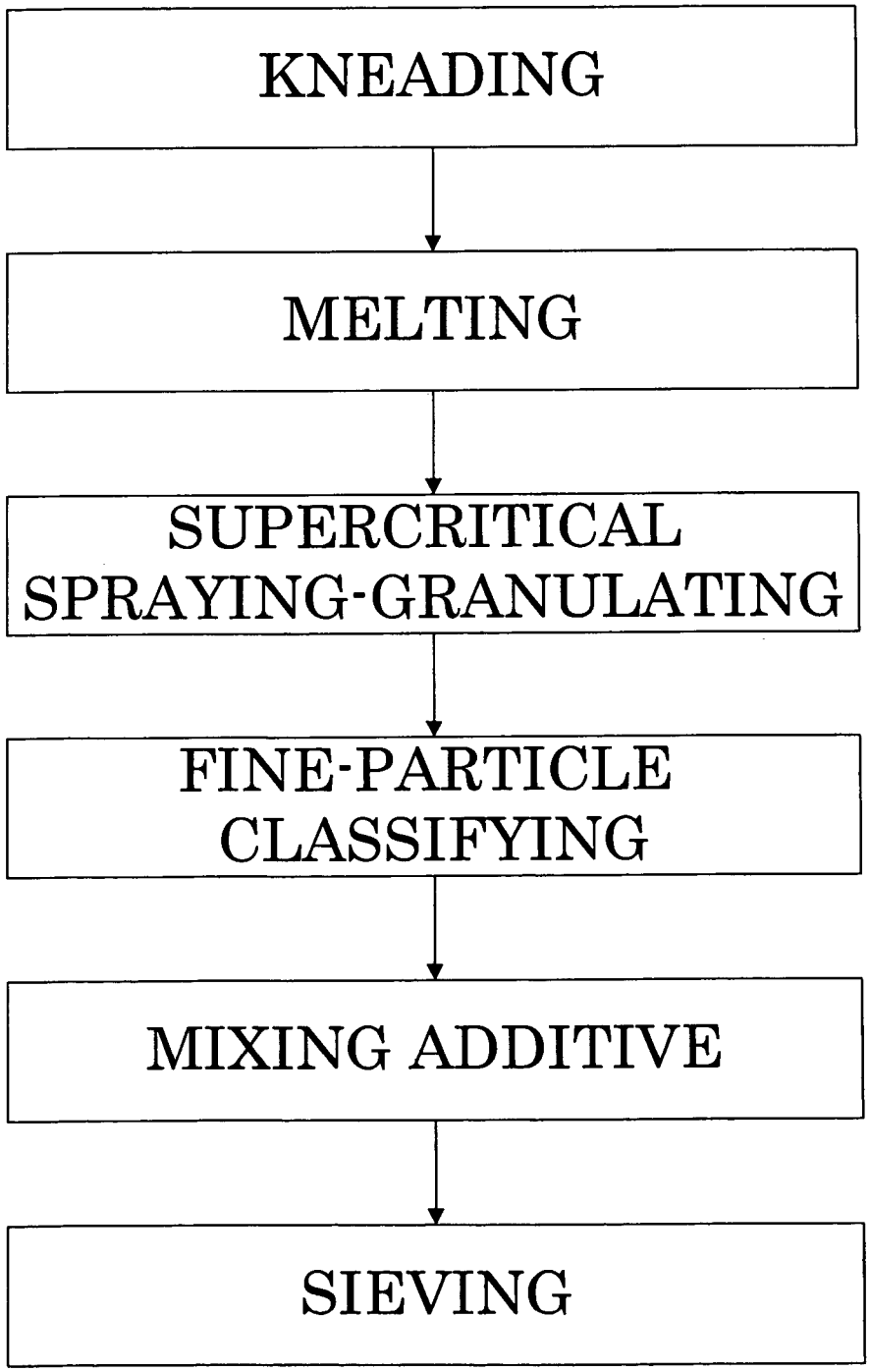
FIG. 13 shows flow chart of an example of the toner manufacturing operation added by a classifying operation, according to the second embodiment under the present invention.

FIG. 13 shows a flow chart of an example of the toner manufacturing operation (for even particle distribution) including a granulating operation added by a classifying operation, according to the second embodiment under the present invention. Making the even distribution of the particles can stabilize the toner's chargeability, thus further improving resolution, image density and graininess.

Hereinafter described are preferable conditions of the toner manufacturing process according to its fourth aspect to sixth aspect under the present invention described above.

Using a supercritical fluid is effective for melting the kneaded composition 1 or for kneading the mixed composition 8, followed by the spraying with the high pressure gas 6 from the high pressure nozzle 4.

Satisfying the following conditions, the supercritical fluid is not specifically limited, and therefore can be properly selected according to the object. Conditions: i) Existing as a non-cohesive high density fluid in a range of temperature and pressure over a limit (critical point) at which gas and liquid can coexist. ii) Not causing cohesion even when being compressed. iii) Having a temperature equal to or more than the critical temperature and a pressure equal to or more than the critical pressure. The supercritical fluid is, however, preferred to have low critical temperature. Preferable examples of the supercritical fluid include carbon monoxide, carbon dioxide, ammonia, nitrogen, water, methanol, ethanol, ethane, propane, 2,3-dimethyl butane, benzene, chlorotrifluoro methane, dimethyl ether and the like. Among the above, carbon dioxide is especially preferable that has the low critical temperature of about 31.3° C., and is easy to handle.

The supercritical fluid can be used alone or in combination of two or more.

The critical temperature and the critical pressure of the supercritical fluid are not specifically limited, and therefore can be properly selected according to the object, preferably the critical temperature is −273° C. to 300° C., more preferably 0° C. to 200° C.

Effectively, the inner pressure of the kneading unit 9-1 for injecting and dispersing the supercritical fluid is 4 MPa to 20 MPa, to thereby carry out the melting of the kneaded composition 1 or the kneading of the mixed composition 8, followed by the spraying with the high pressure gas 6 from the high pressure nozzle 4.

Effectively, the inner temperature of the melting unit 2-1 or the kneading unit 9-1 for injecting or dispersing the supercritical fluid is −10° C. to +100° C. relative to the toner's melting point otherwise +30° C. to +150° C. relative to the toner's glass transition temperature, so as to carry out the melting or the kneading, followed by the spraying with the high pressure gas 6 from the high pressure nozzle 4.

Moreover, the supercritical fluid is effectively to be injected by an amount in a range from 0.5 weight % to 10 weight % relative to a melted toner composition.

It is effective to use a serial melting unit (double-axis or single-axis) and a serial kneading unit (double-axis or single-axis) for injecting the supercritical fluid under an applied pressure, for an even melting or kneading, to be followed by the spraying with the high pressure gas 6 from the high pressure nozzle 4.

Further description is made of the kneading or the melting of the sprayed-granulated toner or the supercritical fluid sprayed-granulated binder resin, in the toner manufacturing process according to its fourth aspect to sixth aspect. Adding an organic solvent for the spraying to thereby obtain the sprayed-granulated composition is preferable for the following reason: The sprayed-granulated composition diffused and cooled in the chamber 3 may become spherical with its surface tension attributable to the cooling. In the above sphericity forming, a difference between the cooling speed of the thermoplastic resin and the gasifying speed of the organic solvent may form an irregularity on a surface of the spherical particle.

Addition of the organic solvent is preferably 0.5 weight % to 5.0 weight %, more preferably 1.0 weight % to 3.0 weight %.

Described below is stabilization of the particle property among the toner's spraying-granulating conditions, in the toner manufacturing process according to its fourth aspect to sixth aspect. The kneading temperature or the melting temperature is preferably not too low or not too high compared with an outflow starting temperature of the toner or of the binder resin. Too low a temperature may cause a fibrous particle, while too high a temperature may carbonize the material thus losing toner's property.

In sum, a proper temperature is preferably −30° C. to +80° C. relative to the toner's outflow starting temperature, more preferably −10° C. to +50° C. relative to the same.

Of the toner's supercritical fluid spraying-granulating conditions, the kneading temperature or the melting temperature cannot be too low or too high compared with the glass transition temperature of the toner or the glass transition temperature of the binder resin, so as to obtain an even graininess.

The kneading temperature or the melting temperature becoming too low may combine a fine particle with a fibrous particle that are not needed for the electrophotographic sprayed-granulated toner, while becoming too high may decrease the surface tension at the cooling thus losing the circularity of the particle.

In sum, a proper temperature is preferably +10° C. to +100° C. relative to the glass transition temperature, more preferably +20° C. to +80° C. relative to the same.

Of the toner's spraying-granulating conditions, the kneading viscosity or the melting viscosity cannot be too low or too high, so as to obtain an even graininess. The kneading viscosity or the melting viscosity becoming too low may cause a fine particle that is not needed for the electrophotographic sprayed-granulated toner, while becoming too high may increase coarse particles.

In sum, a proper viscosity is preferably 1 Pa·s to 400 Pa·s, more preferably 40 Pa·s to 200 Pa·s.

The apparatus used for manufacturing the electrophotographic sprayed-granulated toner under the present invention is preferred to have 4 to 20 spray nozzles per the kneaded-or -melted composition projecting die, for the following reason.

Figure 14:
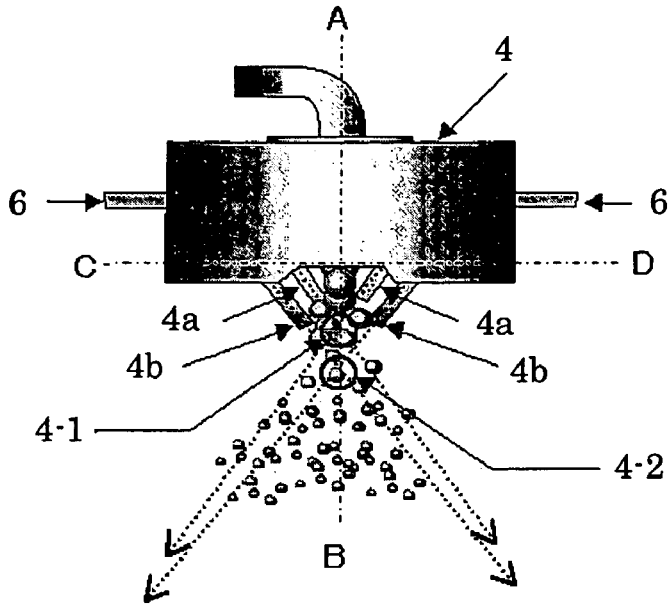
FIG. 14 is an enlarged view showing an example of a high pressure nozzle 4 in FIG. 1 to FIG. 4.
Figure 15:
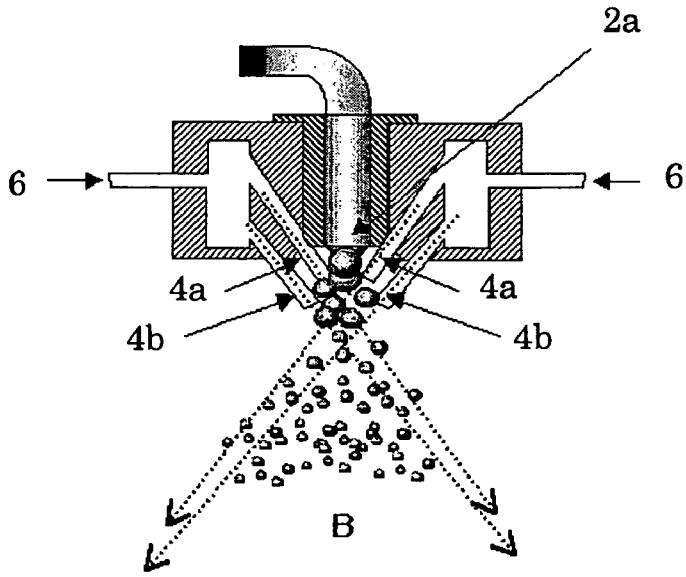
FIG. 15 is a cross sectional view of the high pressure nozzle 4 in a vertical direction in FIG. 14.

FIG. 14 is an enlarged view showing an example of the high pressure nozzle 4 in FIG. 1 to FIG. 4. FIG. 15 is a cross sectional view of the high pressure nozzle 4 in a vertical direction (i.e., A-B) in FIG. 14. FIG. 16 is a cross sectional view of the high pressure nozzle 4 in a horizontal direction (i.e., C-D) in FIG. 14.

In the center of the high pressure nozzle 4, there is provided a kneaded-melted composition ejecting nozzle 2*a* for ejecting the kneaded composition and the melted composition. Around the kneaded-melted composition ejecting nozzle 2*a*, there is provided a spray nozzle 4*a* branched from the high pressure nozzle 4. Around the spray nozzle 4*a*, there is provided a spray nozzle 4*b* branched from the high pressure nozzle 4. The spray nozzle 4*a* and the spray nozzle 4*b* has a Laval constitution causing a supersonic speed or a straight constitution spraying a high pressure.

From the spray nozzle 4*a* and the spray nozzle 4*b*, a supersonic gas (typically an air gas) or a high pressure gas is injected to the toner's kneaded composition or the toner's melted composition ejected from the kneaded-or -melted composition projecting die.

The thus injected gas (for example, the air) from the spray nozzle 4*a* may cause a primary intersection collision, followed by a secondary intersection collision at an end caused by the injected gas from the spray nozzle 4*b*. The above primary intersection collision and the secondary intersection collision may cause a shearing operation, thereby granulating the kneaded composition and the melted composition into fine particles. For increasing the number of collisions depending on the particle's viscosity and the target particle's diameter, the number of spray nozzles 4*a*, 4*b* (in total) is preferably 4 to 20, more preferably 8 to 16.

In the toner manufacturing process under the present invention, causing a supersonic pulse (10 kHz to 80 kHz) to the gas from the spray nozzle 4*a* and the spray nozzle 4*b* for the spraying-granulating is preferred for the following reason: FIG. 17 is a cross sectional view of the high pressure nozzle 4 in a vertical direction (i.e., A-B) in FIG. 14, in which FIG. 17A is a partly enlarged view of the spray nozzle 4*a* and the spray nozzle 4*b*.

In the spray nozzle 4*a* and the spray nozzle 4*b*, there is formed a residing zone 10 for the high pressure gas 6 to reside in. The high pressure gas 6 injected through the spray nozzle 4*a* may be once rolled into the resizing zone 10, then return to a main stream 6*a*, thus causing the supersonic pulse attributable to disordered air flows impinging therebetween.

The thus caused supersonic pulse may cause a strong shearing operation to the kneaded composition and the melted composition, to thereby granulating the kneaded composition and the melted composition into fine particles. The supersonic pulse is preferred to have frequency of 10 kHz to 80 kHz, more preferably 20 kHz to 60 kHz. A pamphlet of International Publication No. WO 02/089998 (company UKNTS) discloses a mechanism and a process of causing the supersonic pulse as described above, obtaining fine particle at a decreased pressure loss and with a low energy.

In the toner manufacturing process under the present invention, the chamber 3 constituting the manufacturing apparatus has its inner face treated with a conductive releasing agent 3*a*.

Figure 18:
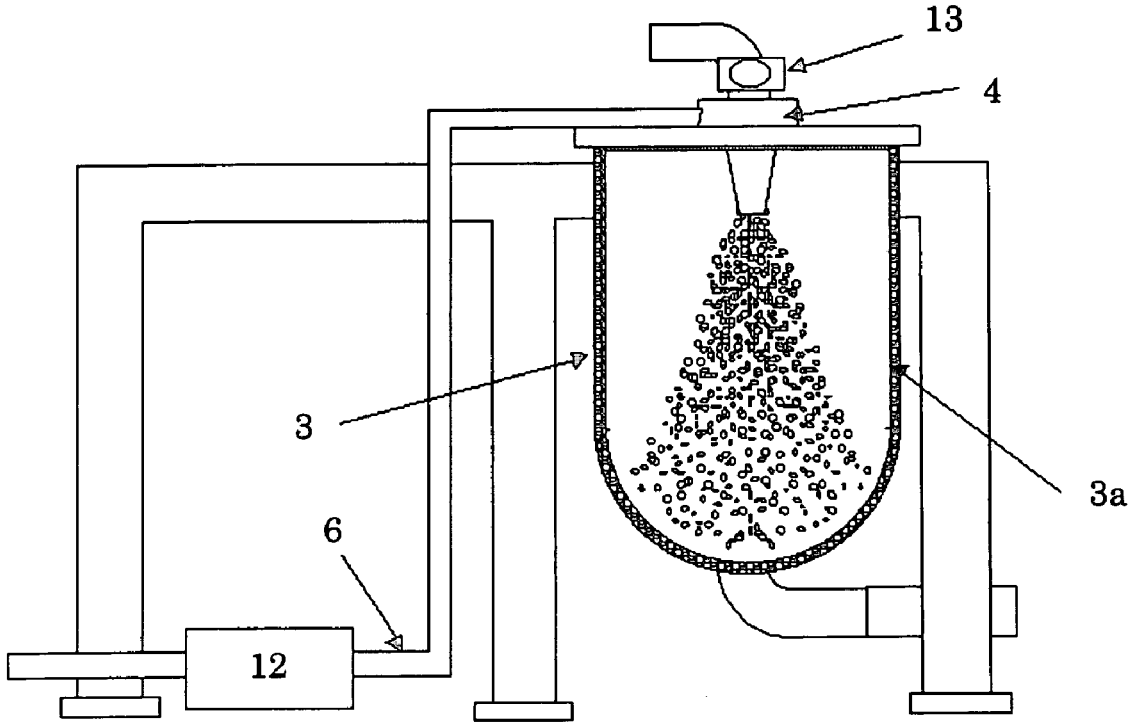
FIG. 18 shows an enlarged view of a chamber 3 of the spraying-granulating apparatus used for the toner manufacturing operation, under the present invention.

FIG. 18 is an enlarged view of the chamber 3 in FIG. 1 to FIG. 4.

Use of the chamber 3 having its inner face treated with the conductive releasing agent 3*a* can suppress adhesion, cohesion, fusion, and fixation which may be caused by the spraying, and can be less likely to cause static electricity when the toner slides in the dispersing unit, which are preferable.

The treatment with the conductive releasing agent 3*a* is carried out by coating the following materials on the inner face of a fluidity layer. A fundamental fluorine resin having about $10^6$ Ω·cm to $10^9$ Ω·cm of electric resistance: PTFE (Teflon (trade mark registered)), PFA (tetrafluoro ethylene-perfluoro alkyl vinyl ether copolymer), FEP (tetrafluoro ethylene-hexafluoro propylene copolymer), ETFE (tetrafluoro ethylene-ethylene copolymer).

The thus treated inner face of the chamber 3 is preferred to have $10^3$ Ω·cm to $10^{16}$ Ω·cm of electric resistance and $10^3$ Ω·cm to $10^{16}$ Ω·cm of volume resistance.

In the toner manufacturing process under the present invention, adjusting the nozzle pressure for the spraying-granulating is preferred for controlling the particle diameter in the spraying-granulating, with a preferable spraying-granulating pressure of 0.3 MPa to 0.8 MPa, more preferably 0.4 MPa to 0.7 MPa.

In the toner manufacturing process under the present invention, adjusting the chamber 3's inner pressure for the spraying-granulating is preferred for unifying the granules in the chamber 3, with a preferable pressure range of −0.01 MPa to 0.01 MPa, more preferably −0.005 MPa to 0.005 MPa.

In FIG. 18, a blower absorption is carried out for adjusting an inner part of the chamber 3. The blower absorption is seen in FIG. 1, FIG. 2, FIG. 3 and FIG. 4, denoted by reference numeral 11.

In the toner manufacturing process under the present invention, adjusting the temperature of the high pressure gas 6 is preferred for easily carrying out the spraying-granulating.

In FIG. 18, a pipe of the high pressure gas 6 is provided with a heat exchanger 12, smoothing the intersection collision and the shearing operation of the mixed composition and melted composition which are ejected, thus facilitating the spraying-granulating.

The high pressure gas 6 may have a preferable temperature of 50° C. to 250° C., more preferably 70° C. to 200° C.

In the toner manufacturing process under the present invention, adjusting the temperature for kneading and melting the binder resin, the colorant, the charge controlling agent, the releasing agent and the like in the melting unit 2, the kneading unit 9, the melting unit 2-1 and the kneading unit 9-1 in FIG. 1 to FIG. 4 can effectively improve dispersibility of the sprayed-granulated toner material and prevent material deterioration attributable to thermal hysteresis. The temperature for the kneading and the melting is preferably 50° C. to 200° C., more preferably 70° C. to 180° C.

In the toner manufacturing process under the present invention, adjusting the inner pressure of the chamber 3 for the spraying-granulating can effectively granulate the sprayed particle into sphere.

In FIG. 18, with its surface tension, the particle sprayed into the chamber 3 may become spherical. In this case, the thus sprayed-granulated spherical particles causing collisions with each other may be in need of a momentary cooling for preventing a secondary cohesion.

Therefore, the chamber 3 preferably has the inner temperature of −10° C. to 80° C., more preferably 20° C. to 50° C.

In the toner manufacturing process under the present invention, imparting a vibrational force to the kneaded-melted composition ejecting nozzle 2*a* for ejecting the binder resin and adjusting the frequency of the vibrational force can effectively eject the kneaded-melted composition with the temperature of the kneaded-melted composition decreased.

FIG. 18 shows the electrophotographic sprayed-granulated toner manufacturing process in which a vibrator 13 disposed on the high pressure nozzle 4 imparts a vibration to the kneaded-melted composition ejecting nozzle 2*a* shown in the cross sectional view in FIG. 15, to thereby eject the kneaded-melted composition at the decreased temperature of the kneaded-melted composition.

The vibrator 13 is preferred to be of an air driving type, an electromagnetic type and the like such that the vibrational force caused thereby is preferably 500 N to 8000 N with the frequency of 0.55 kHz to 2.00 kHz, especially preferably, the vibrational force of 1000 N to 6000 N with the frequency of 0.80 kHz to 1.50 kHz.

The sprayed-granulated particle after the classification in the toner manufacturing process under the present invention is preferred to have volume average particle diameter of 3.0 μm to 10.0 μm, more preferably 4.0 μm to 7.0 μm, for the purpose of improving the gradation in the mage forming.

Preferable examples of the classifier used for the toner manufacturing process under the present invention include i) a 2-operation mechanical classifier of wheel type, ii) a mechanical classifier of wheel type, iii) a classifier using Coanda effect, iv) a classifier of an air-flow type using a swirl, v) and the like, thus manufacturing the toner taking the operations in FIG. 7, FIG. 9, FIG. 11 and FIG. 13.

In the toner manufacturing process under the present invention, the classification of the sprayed-granulated products is carried out for improving dot reproducibility in the image forming, preferably having a ratio of number average particle diameter to volume average particle diameter of 1.03 to 1.50, more preferably 1.06 to 128.

In the toner manufacturing process under the present invention, the average circularity of the sprayed-granulated composition is 0.85 to 0.99, more preferably 0.94 to 0.97, for improving transferability in the image forming.

The electrophotographic sprayed-granulated toner after the classification in the toner manufacturing process under the present invention is preferred to have fine-particle (diameter of 2 μm or less) content of 5 POP. % or less, more preferably 2 POP. % or less, for decreasing transferred dust in the image forming. Hereinabove, the POP. % is a number % which is measured in a Colter method.

Under the present invention, adding to the toner an inorganic fine particle (such as silica fine particle, titanium oxide fine particle, and the like) after the supercritical fluid spraying-granulating can impart fluidity to the toner.

Under the present invention, the known image forming process is applicable, provided that the toner under the present invention be used therefor.

The image forming apparatus under the present invention is preferred to include at least the following units: i) a unit for forming a latent image on an electrostatic latent image bearing member, ii) a developing unit for developing the latent image, thus forming a toner image, and iii) a transferring unit for transferring the toner image to a transfer material, and iv) a cleaning unit for cleaning the electrostatic latent image bearing member after the transferring.

The graininess which is one of the evaluation criteria of the image is a physical quantity representing roughness of the image, as is described in "Fine imaging and hard copy (edited by Society of Photographic Science and Technology of Japan and The Imaging Society of Japan, and issued on Jan. 7, 1999)." More specifically, a micro densitometer and the like are to be used for scanning a minor opening of an image having a uniform density, to thereby obtain a standard deviation of image density distribution or of image luminosity distribution.

In the case of a monochrome image, graininess thereof can be obtained by the expression defined by Dooley. In the case of color image, the graininess of the monochrome image is to be weighted by a graininess measured with blue, red, and green, to thereby obtain graininess.

Being the standard deviation of the image density distribution or of the image luminosity distribution, the graininess is preferred to be small in number, preferably, 1.0 or less as an image of a graphic copy.

Hereinafter described are compositions constituting the toner under the present invention.

The toner under the present invention contains at least a binder resin, a colorant, a charge controlling agent, a releasing agent and a magnetic agent, and when necessary, contains other composition(s).

The binder resin is not specifically limited, and therefore can be properly selected from those known in the art, according to the object. Preferable examples of the binder resins include vinyl resin, polyester resin, polyol resin. Among the above, polyester resin or polyol resin are especially preferable.

Examples of vinyl resin include styrenes (such as polystyrene, poly-p-chlorostyrene, polyvinyl toluene and the like) or homopolymer of substitution product thereof; styrene copolymers such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloro methyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer, and the like; polymethyl methacrylate; polybutyl methacrylate; polyvinyl chloride; polyvinyl acetate; and the like.

The above polyester resin is preferred to be made of (A) divalent alcohol, (B) dibasic acid or salt thereof. Moreover, the above polyester resin may be added, as a tertiary composition, by (C) trivalent (or more) alcohol or carboxylic acid.

Examples of the divalent alcohol in the above (A) include ethylene glycol, triethylene glycol, 1,2-propylene glycol, 1,3-propylene glycol, 1,4-butanediol, neopentyl glycol, 1,4-butanediol, 1,4-bis(hydroxy methyl)cyclohexane, bisphenol A, hydrogen-added bisphenol A, polyoxy ethylene bisphenol A, polyoxy propylene (2,2)-2,2'-bis(4-hydroxy phenyl)propane, polyoxy propylene (3,3)-2,2-bis(4-hydroxy phenyl)propane, polyoxy ethylene (2,0)-2,2-bis(4-hydroxy phenyl)propane, polyoxy propylene (2,0)-2,2'-bis(4-hydroxy phenyl) propane, and the like.

Examples of the dibasic acid or salt thereof in the above (B) include maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, linolenic acid, acid anhydride of the above compositions, esters of lower alcohol with the above compositions, and the like.

Examples of the trivalent (or more) alcohol or carboxylic acid in the above (C) include alcohols such as glycerin, trimethyl propane, pentaerythritol; carboxylic acids such as trimellitic acid, pyromellitic acid; and the like.

Examples of the polyol resin include i) alkylene oxide adduct of epoxy resin and dihydric phenol, ii) a reactant of (a) a compound having in its molecule one active hydrogen which reacts with a glycidyl ether and epoxy radical, with (b) a compound having in its molecule two or more active hydrogens which react with epoxy radical.

Moreover, when necessary, other resins may be combined, examples thereof including epoxy resin, polyamide resin, urethane resin, phenol resin, butyral resin, rosin, modified resin, terpene resin, and the like. Typical examples of the above epoxy resin include polycondensation product of bisphenol (such as bisphenol A, bisphenol F and the like) with epichlorohydrin.

Examples of the colorant are described below.

Examples of a black pigment include azine pigment such as carbon black, oil furnace black, channel black, lamp black, acetylene black, aniline black, and the like; metallic salt azo pigment; metal oxide; compound metal oxide; and the like.

Examples of yellow pigment include cadmium yellow, mineral fast yellow, nickel titanium yellow, navel yellow, naphthol yellow S, Hanza yellow G, Hanza yellow 10G, benzidine yellow GR, quinoline yellow lake, permanent yellow NCG, tartrazine lake, and the like.

Examples of orange pigment include molybdenum orange, permanent orange GTR, pyrazolone, Vulcan orange, indanthrene brilliant orange RK, benzidine orange G, indanthrene brilliant orange GK, and the like.

Examples of red pigment include red iron oxide, cadmium red, permanent red 4R, lithol red, pyrazolone red, watching red calcium salt, lake red, D, brilliant carmine 6B, eosin lake, rhodamine lake B, alizarin lake, brilliant carmine 3B and the like.

Examples of violet pigment include fast violet B, methyl violet lake and the like.

Examples of blue pigment include cobalt blue, alkali blue, Victoria blue lake, phthalocyanine blue, nonmetal phthalocyanine blue, phthalocyanine partly chloride, fast sky blue, indanthrene blue BC, and the like.

Examples of green pigment include chromium green, chromium oxide, pigment green B, malachite green lake, and the like.

The above pigments can be used alone or in combination of two or more.

Amount of the added pigment is not specifically limited, and therefore can be properly selected according to the object, in general, preferably 0.1 weight part to 50 weight part relative to 100 weight part of binder resin.

The releasing agent is not specifically limited, and therefore can be properly selected from those known in the art, according to the object, preferable examples thereof including waxes and the like.

Examples of waxes include low molecular polyolefine wax, synthetic hydrocarbon wax, natural waxes, petroleum waxes, higher fatty acid and metallic salt thereof, higher fatty acid amide, various modified waxes of the above, and the like. The above waxes may be used alone or in combination of two or more.

Examples of the low molecular polyolefine wax include low molecular polyethylene wax, low molecular polypropylene wax, and the like.

Examples of the synthetic hydrocarbon wax include Fischer-Tropsch wax and the like.

Examples of the natural waxes include bees wax, carnauba wax, candelilla wax, rice wax, montan wax, and the like.

Examples of the petroleum waxes include paraffin wax, micro crystalline wax, and the like.

Examples of the higher fatty acid include stearic acid, palmitic acid, myristic acid, and the like.

Content of the releasing agent in the toner is not specifically limited, and therefore can be selected according to the object, preferably 0 mass part to 40 mass part, more preferably 3 mass part to 30 mass part.

The charge controlling agent is not specifically limited, and therefore can be properly selected from those known in the art, according to the object. Examples of the charge controlling agent include nigrosine, modified product of fatty acid metallic salt and the like of nigrosine, acetyl acetone metal complex, monoazo metal complex, naphthoic acid, and the like.

The toner under the present invention may be a magnetic toner containing magnetic agent. The above magnetic agent is not specifically limited, and therefore can be properly selected from those known in the art, according to the object.

Examples thereof include iron oxides such as magnetite, hematite, and the like; ferrite; and the like.

Moreover, for imparting fluidity to the toner, an inorganic fine particle such as silica fine particle, titanium oxide fine particle and the like may be added, as an external additive, to the toner.

The toner under the present invention is not specifically limited in terms of its configuration, size and the like, and therefore can be selected according to the object. Preferably, the toner under the present invention has the following average circularity, volume average particle diameter, ratio (volume average particle diameter/number average particle diameter), content of fine particle with particle diameter of 2 μm or less, and the like.

The volume average particle diameter of the toner is preferably 3.0 μm to 10.0 μm, more preferably 4.0 μm to 7.0 μm.

The ratio (volume average particle diameter/number average particle diameter) is preferably 1.03 to 1.50, more preferably 1.06 to 1.28.

The volume average particle diameter and the ratio (volume average particle diameter/number average particle diameter) can be measured, for example, with a graininess measuring instrument branded as "Colter counter TAII" made by Colter Electronics.

The average circularity of the toner under the present invention is preferably 0.85 to 0.99, more preferably 0.94 to 0.97.

Herein, the average circularity can be measured, for example, by an optical sensing zone process in which a suspension containing the toner is passed to an image pickup sensing zone on a flat plate thereby a particle image is optically sensed and analyzed with a CCD (charge coupled device) camera. Used for the above process is, for example, a flow-type particle image analyzer FPIA-2100 (made by Sysmex Corporation) and the like.

The content of the fine particle with particle diameter of 2 μm or less is preferably 5 POP. % or less, more preferably 2 POP. % or less.

(Developer)

The developer under the present invention comprises the toner under the present invention, and the other components such as carrier selected properly. The developer may be a single-component or a double-component developer; however, the developer is preferably of double-component type in light of such factor as prolonged life, in order to be applied to high-speed printers for the purpose of nowadays-increased information processing rate.

In the case of the single-component developer comprising the toner under the present invention, even after consumption and addition of the toner, the variation of the toner particle diameter is minimized, filming of the toner to a development roller is prevented, toner fusion to members such as a toner blade which controls the toner thickness (namely, thinning of toner) is prevented, and excellent and stable developability and images may be obtained even after the developing apparatus is utilized (stirred) for a long period. Further, in the case of the double-component developer comprising the toner under the present invention, even after prolonged consumption and addition of the toner, the variation of the toner particle diameter is minimized, and even after the developing apparatus is stirred for a long period, excellent and stable developability may be obtained.

The carrier may be properly selected, without particular limitations, depending on the application, preferably the carrier is one having core material and resin layer coating on the core material.

The material for the core may be properly selected from conventional materials without particular limitations; for example, the material based on manganese-strontium (Mn—Sr) of 50 emu/g to 90 emu/g and the material based on manganese-magnesium (Mn—Mg) are preferable, high magnetizing materials such as iron powder (100 emu/g or more) and magnetite (75 emu/g to 120 emu/g) are preferable from the standpoint of securing image density. Also, weak magnetizing materials such as copper-zinc (Cu—Zn) (30 emu/g to 80 emu/g) are preferable from the standpoint of aiming for higher-grade images by means of softening the contact of the toner with the photoconductor where the toner is standing. Each of these materials may be employed alone or in combination of two or more.

As for the particle diameter of the core material, preferably the average particle diameter (volume-average particle diameter ($D_{50}$)) is 10 μm to 150 μm, more preferably 40 μm to 100 μm. When the average particle diameter ($D_{50}$) is less than 10 μm, the carrier particle distribution contains fine particle in a significant amount, which may cause carrier scattering due to lowered magnetization per one particle; on the other hand, when the average particle diameter ($D_{50}$) exceeds 150 μm, the specific surface area becomes lower, which may cause toner scattering and may deteriorate the reproducibility especially of the solid parts in full-color printing that contains a number of solid parts.

The material for the resin layer may be properly selected from conventional materials depending on the application without particular limitations; examples of the material for the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoro ethylene resins, polyhexafluoropropylene resins, copolymers of vinylidene fluoride with acrylic monomer, copolymers of vinylidene fluoride with vinyl fluoride, fluoroterpolymers such as the terpolymer of tetrafluoroethylene, vinylidene fluoride and a non-fluoride monomer, silicone resins, and the like. Each of these resins may be used alone or in combination of two or more.

The amino resins include, for example, urea-formaldehyde resins, melamine resins, benzoguanamine resins, urea resins, polyamide resins, epoxy resins, and the like. The polyvinyl resins include acrylic resins, polymethyl methacrylate resins, polyacrylonitrile resins, polyvinyl acetate resins, polyvinyl alcohol resins, polyvinyl butyral resins, and the like. The polystyrene resins include polystyrene resins, styrene-acryl copolymer resins and the like. The halogenated olefin resins include polyvinyl chloride and the like. The polyester resins include polyethylene terephthalate resins, polybutylene terephthalate resins and the like.

The resin layer may contain such material as conductive powder depending on the application; as for the conductive powder, metal powder, carbon black, titanium oxide, tin oxide, zinc oxide, and the like are preferably exemplified. These conductive powders preferably have an average particle diameter of 1 μm or less. When the average particle diameter is more than 1 μm, it may be difficult to control electrical resistance.

The resin layer may be formed by first dissolving the silicone resin and the like into a solvent to prepare a coating solution, then uniformly coating the surface of the core material with the coating solution by means of the immersion process, the spray process, the brush painting process and the like, and baking it after drying.

There is no particular limitation for the solvent and it may be selected suitably according to the object from toluene, xylene, methylethylketone, methylisobutylketone, celsorbutylacetate, and the like.

The baking process may be an externally heating process or an internally heating process, and can be selected from, for example, a process using either a fixed type electric furnace, a fluid type electric furnace, a rotary type electric furnace, and a burner furnace, or process of using a microwave and the like.

The ratio of the resin layer (resin coating amount) in the carrier is preferably 0.01% by mass to 5.0% by mass based on the entire amount of the carrier. When the ratio is less than 0.01% by mass, it is difficult to form a uniform resin layer on the surface of the core material, on the other hand, when the ratio exceeds 5.0% by mass, the resin layer becomes too thick and the carrier particles tend to grow due to the granulation of carriers, as a result the uniform carrier of fine particles may not be obtained.

When the developer for electrophotography contains the double components, the content of the carrier in the double-component developer is not especially limited and may be properly selected depending on the application, for example it is preferably 90% by mass to 98% by mass, more preferably 93% by mass to 97% by mass.

Mixture ratio of the double-component developer (i.e., the toner to the carrier) is, in general, 100 mass part of the carrier to 1 mass part to 10 mass part of the toner.

Since the developer under the present invention comprises the toner under the present invention, the visible high quality image can be stably formed that is so excellent as to be comparable with a silver salt image in fine-line reproducibility, gradation and the like.

The developer under the present invention may be preferably used for image formation by various electrophotographic processes such as a magnetic single-component developing process, a non-magnetic single-component developing process, a double-component developing process, and the like, especially preferably used for the toner container, the process cartridge, the image forming apparatus, and the image forming process described below.

(Toner Container)

The toner container under the present invention contains the toner and the developer under the present invention.

The above toner container is not specifically limited, and therefore can be properly selected from those known in the art, according to the object, examples thereof including the one having a toner container body and a cap.

Size, configuration, constitution, material and the like of the toner container are not specifically limited, and therefore can be properly selected according to the object. For example, the configuration is preferred to be cylindrical and the like, formed with spiral irregularity on an inner face of the container, and having the following features: Rotating the container can move the toner (contents) toward the outlet, and the above spiral irregularity entirely or partly acts as bellows.

The material for the toner container body is not specifically limited, and therefore can be properly selected according to the object, those having good dimensional accuracy being preferred. Examples thereof include resins, especially preferable are polyester resin, polyethylene resin, polypropylene resin, polystyrene resin, polyvinyl chloride resin, polyacrylic resin, polycarbonate resin, ABS resin, polyacetal resin, and the like.

The toner container under the present invention is easy in terms of storage, conveyance and the like, and is excellent in handling. Moreover, for use of toner supply, the toner container under the present invention can be detachably mounted to the process cartridge, the image forming apparatus and the like which are described afterward.

Examples of the above toner container include those conventionally known and generally used such as i) a container incorporating an agitator, ii) a plastic container with its wall having a spiral constitution, and iii) a cartridge-type container. More specifically about this in conjunction with sales: One sales method is taken into account that supplies, otherwise than a body of the image forming apparatus, the container itself to the user by filling the toner in the above container. Another sales method taken into account recently is to supply the toner to the user's own container.

The toner under the present invention described above may be used for the electrophotographic image forming apparatus of monochrome type that is provided with i) an electrostatic latent image bearing member, ii) a developing unit for developing the latent image (formed on the electrostatic latent image bearing member) with the toner, iii) a transferring unit for transferring the developed toner image to a recording medium, and iv) a fixing unit for fixing the toner image transferred to the image medium. The toner under the present invention can also be used for the electrophotographic image forming apparatus of full-color type including tandem type. Moreover, the toner under the present invention is usable for a single-component developing process (toner alone) and a double-component developing process (toner and carrier combined). Usually, the toner contained in the above toner container is to be installed in the image forming apparatus, acting as part of the developing unit.

Recently, a process cartridge is otherwise prepared that is of detachable type (i.e., detachably mounted to the body of the image forming apparatus) and is provided at least with an electrostatic latent image bearing member and a developing unit. Not to mention, the toner under the present invention is applied to the above detachable-type process cartridge.

Using the thus constituted image forming apparatus for an ordinary electrophotography may i) allow the toner to develop the latent image formed on the electrostatic latent image bearing member, ii) transfer the thus developed toner image to the recording medium, and then iii) fix the toner image thus transferred, to thereby form a copy image on the recording medium.

(Process Cartridge)

The process cartridge under the present invention has at least i) an electrostatic latent image bearing member for bearing an electrostatic latent image, and ii) a developing unit for developing with a developer the electrostatic latent image which is born on the electrostatic latent image bearing member, to thereby form a visible image. Moreover the process cartridge under the present invention has a charging unit, an exposing unit, a developing unit, a transferring unit, a cleaning unit, a deelectrifying unit, and the like which are properly selected when necessary.

The above developing unit is provided with at least i) a developer container for containing the toner and the developer under the present invention, and ii) an electrostatic latent image bearing member for bearing and conveying the toner and the developer contained in the above developer container. Moreover, the developing unit may have a regulating member and the like for regulating thickness of the toner layer to be born.

The process cartridge under the present invention is preferred to be detachably mounted to various electrophotographic apparatuses, facsimile, printer and the like, moreover detachably mounted to the image forming apparatus under the present invention to be described afterward.

Figure 22:
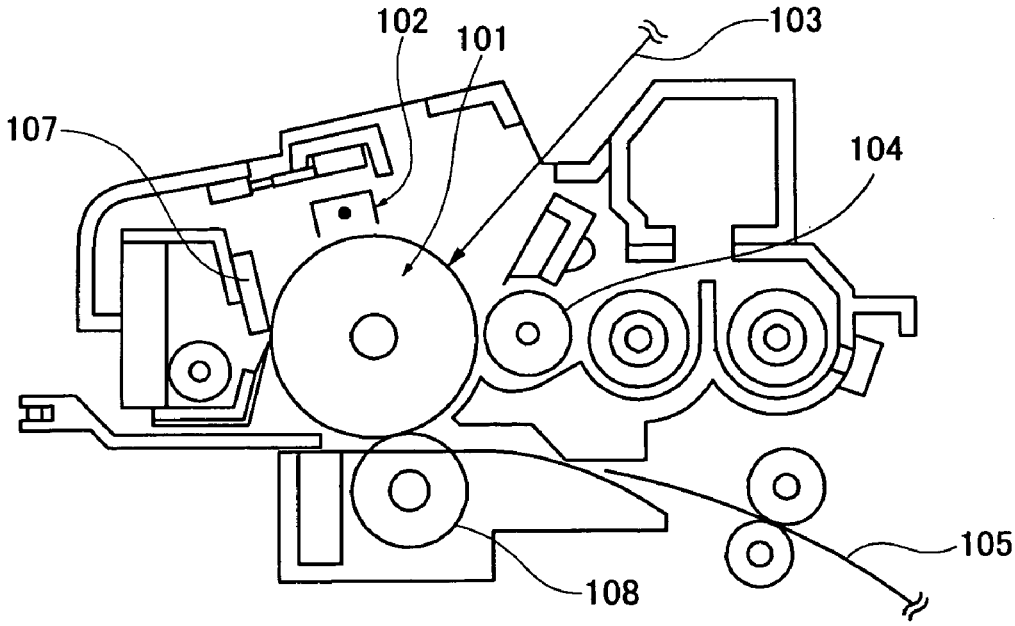
FIG. 22 is a schematic of an example of the process cartridge under the present invention.

The process cartridge under the present invention is, as is seen in FIG. 22 for example, incorporates a photoconductor 101, and has a charging unit 102, an exposing unit 103, a developing unit 104, a transferring unit 105, a cleaning unit 107, a deelectrifying unit 108, and the like, moreover may have other member(s) when necessary.

The photoconductor 101 has a support; and on the support sequentially, at least a charge generating layer, a charge transporting layer, and a cross-linking charge transporting layer.

An example of the exposing unit 103 is a light source capable of carrying out writing with high resolution.

An example of the charging unit 102 is an arbitrary charging member, preferably a scorotron charging.

The image forming apparatus under the present invention may be so constituted that the above photoconductor 101, the developing unit 104, the cleaning unit 107 are integrated as a process cartridge, which integration being allowed to be detachably mounted to the body of the image forming apparatus. Moreover, the image forming apparatus under the present invention may be so constituted that at least one of a charging device, an image exposing device, a transferring device, a separating device, and a cleaning device is integrated with the photoconductor 101, to thereby form the process cartridge. In the above latter constitution, the process cartridge is a single unit that is detachably mounted to the body of the image forming apparatus by means of a guide unit such as rails of the body of the image forming apparatus.

(Image Forming Apparatus and Image Forming Process)

The image forming apparatus under the present invention comprises an electrostatic latent image bearing member, an electrostatic latent image forming unit, a developing unit, a transferring unit and a fixing unit, and may further comprise the other units, for example, a deelectrifying unit, a cleaning unit, a recycling unit and a controlling unit which are properly selected when necessary.

The image forming process under the present invention comprises forming an electrostatic latent image, developing, transferring and fixing, and may further comprise the others, for example, deelectrifying, cleaning, recycling and controlling which are properly selected when necessary.

The image forming process under the present invention may be preferably carried out by the image forming apparatus under the present invention. The electrostatic latent image forming may be performed by the electrostatic latent image forming unit, the developing may be performed by the developing unit, the transferring may be performed by the transferring unit, and the fixing may be performed by the fixing unit. The others may be performed by the other unit(s).

Electrostatic Latent Image Forming, and Electrostatic Latent Image Forming Unit

In the electrostatic latent image forming, an electrostatic latent image is formed on an electrostatic latent image bearing member.

Material, configuration, constitution, size and the like of the electrostatic latent image bearing member (otherwise, referred to as "photoconductive insulator" and "photoconductor") are not specifically limited, and therefore can be properly selected from those known in the art. The configuration is preferred to be a drum. The material is preferred to be inorganic photoconductors such as amorphous silicone, selenium and the like; and organic photoconductors such as polysilane, phthalo polymethine and the like. In terms of longevity, the amorphous silicone and the like are especially preferred.

The electrostatic latent image may be formed, for example, by uniformly charging the surface of the electrostatic latent image bearing member, and exposing it imagewise, which may be performed by the electrostatic latent image forming unit.

The electrostatic latent image forming unit, for example, comprises a charging device which uniformly charges the surface of the electrostatic latent image bearing member, and an exposing device which exposes the surface of the electrostatic latent mage bearing member imagewise.

The charging may be performed, for example, by applying a voltage to the surface of the electrostatic latent image bearing member by means of the charging device.

The charging deice is not specifically limited, and therefore can be properly selected according to the object, examples thereof including known contact charging devices equipped with roll, brush, film, rubber blade and the like which are conductive or semi-conductive; non-contact charging devices using corona discharge such as corotron, scorotron and the like; and the like.

The light exposing may be performed by exposing light on the surface of the electrostatic latent image bearing member imagewise, using the exposing device for example.

The exposing device may be properly selected depending on the application provided that the surface of the electrostatic latent image bearing member charged by the charging device be exposed imagewise; for example, such exposing devices as copy optical system, rod lens array system, laser optical system and liquid crystal shutter optical system may be preferably exemplified.

In addition, under the present invention, a backlight process may be employed in which the electrostatic latent image bearing member is exposed imagewise from its back surface.

Developing, and Developing Unit

In the developing, the electrostatic latent image is developed using the toner or the developer under the present invention to form a visible image.

The visible image may be formed, for example, by developing the electrostatic latent image using the toner or the developer, which may be performed by means of the developing unit.

The developing unit may be properly selected from those known in the art, provided that the developing unit develop an image for example using the toner or the developer under the present invention. For example, such a unit is preferable as contains the toner or the developer under the present invention and comprises a developing device which may supply the toner or the developer to the electrostatic latent image, in such a manner as to cause or not cause contact therewith. Especially, a developing device equipped with the toner container under the present invention is preferable.

The developing device may be of dry type or wet type, and may be a monochrome developing or multi-color developing device. For example, such a device is preferable as comprises a stirrer that charges the toner or the developer by friction stirring, and a rotatable magnet roller.

In the developing device, for example, the toner and the carrier are mixed and stirred; the toner is thereby charged by friction and sustained standing in a form of rice ears, and forms a magnetic brush on the surface of the rotating magnet roller. Since the magnet roller is arranged near the electrostatic latent image bearing member (photoconductor), part of the toner constituting the magnetic brush formed on the surface of the magnet roller moves to the surface of the photoconductor due to the force of electrical attraction. As a result, this toner develops an electrostatic latent image, and a visible toner image is formed on the surface of the photoconductor.

The developer housed in the developing device contains the toner under the present invention; the developer under the present invention may be a single-component developer or a double-component developer.

Transferring and Transferring Unit

In the transferring, the visible image is transferred to a recording medium. Preferably, the visible image is transferred to an intermediate transfer member as the primary transfer, then the visible image is transferred on the recording medium as the secondary transfer. More preferably, using a toner of two or more colors and still more preferably using a full color toner, the visible image is transferred to the intermediate transfer member to form a complex-transferred image as the primary transfer, and the complex-transferred image is transferred to the recording medium as the secondary transfer.

The transferring may be achieved, for example, by charging the electrostatic latent image bearing member (photoconductor) using a transfer-charging device, which may be performed by the transferring unit. Preferably, the transferring unit comprises a primary transferring unit that transfers the visible image to the intermediate transfer member to form a complex-transferred image, and a secondary transferring unit that transfers the complex-transferred image to the recording medium.

The intermediate transfer member may be properly selected from those known in the art, for example, a transferring belt may be preferably exemplified.

The transferring unit (the primary transferring unit and the second transferring unit) preferably comprises a transferring device that conducts a releasing-charging of the visible image (formed on the photoconductor) to the recording medium side. The transferring unit may be one or more.

Examples of the transferring device include a corona transferring device based on corona discharge, transfer belt, transfer roller, pressure transfer roller, adhesion transferring device and the like.

As long as having capability of transferring unfixed image after the developing, the recording medium is typically plain paper, but is not limited thereto, and may be selected depending on the application; a polyethylene terephthalate (PET) base for over head projector (OHP) may be employed.

In the fixing, the visible image transferred to the recording medium is fixed by means of a fixing device. The fixing may be carried out with respect to the individual toners of respective colors transferred to the recording medium, or may be carried out in one operation after the toners of entire colors have been laminated.

The fixing apparatus is not specifically limited, and therefore may be selected according to the object from heating-pressing units known in the art. Examples of heating-pressing units include a combination of heating roller and pressing roller, and a combination of heating roller, pressing roller and endless belt.

The heating temperature in the heating-pressing unit is preferably 80° C. to 200° C.

Also under the present invention, an optical fixing device known in the art may be used depending on the application, in addition to or in replacement of the fixing process and the fixing unit.

In the deelectrifying, a deelectrifying bias is applied to the photoconductor to conduct the deelectrifying, which may be performed by a deelectrifying unit.

Provided that a deelectrifying bias be applied to the photoconductor, the deelectrifying unit is not specifically limited, and therefore may be properly selected from those known in the art; for example, a deelectrifying lamp and the like are preferable.

In the cleaning, the electrophotographic toner remaining on the photoconductor is removed by means of a cleaning unit.

Provided that the electrophotographic toner remaining on the photoconductor be removed, the cleaning unit is not specifically limited, and therefore may be properly selected from those known in the art; examples thereof include a magnetic brush cleaner, an electrostatic brush cleaner, a magnetic roller cleaner, a blade cleaner, a brush cleaner, a web cleaner and the like.

In the recycling, the color electrophotographic toner removed in the cleaning is recycled to the developing unit, which is performed by a recycling unit.

The recycling unit is not specifically limited, and therefore may be properly selected from transport units and the like known in the art.

In the controlling, the respective operations described above are controlled, and may be properly implemented by a controlling unit.

Provided that the respective operations be controlled, the controlling unit is not specifically limited, and therefore may be properly selected depending on the application; examples thereof include a device such as a sequencer and a computer.

Figure 20:
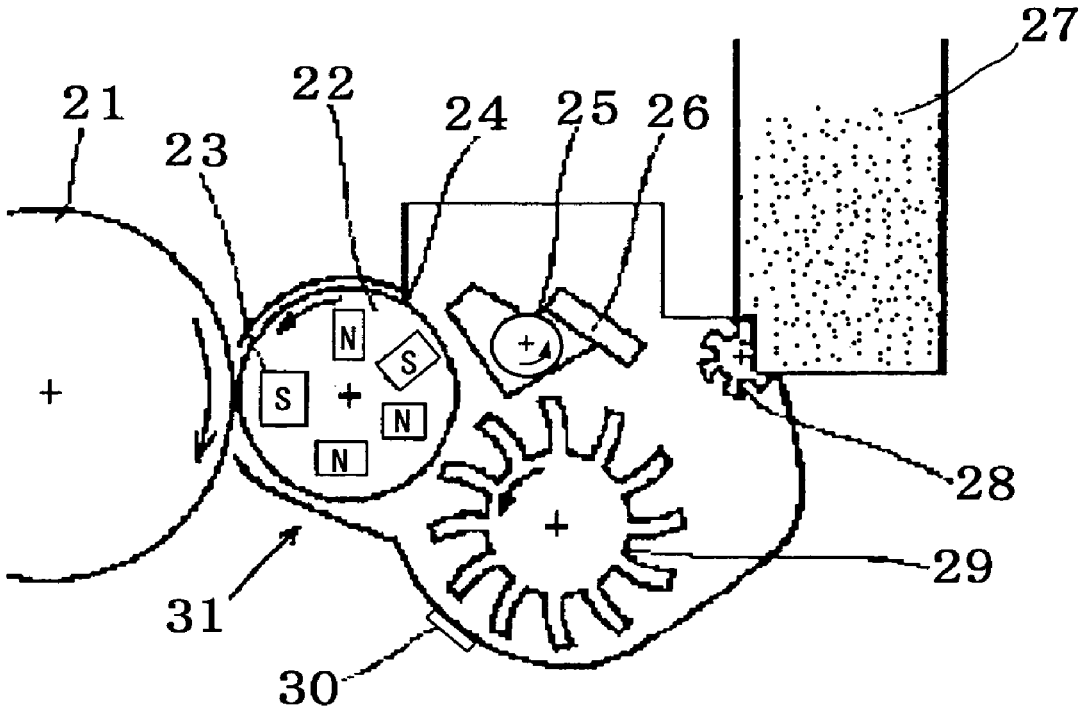
FIG. 20 is a schematic showing an example, especially, a part of a developing portion of an image forming apparatus using a toner under the present invention.

Hereinafter described referring to FIG. 20 is a first embodiment of the image forming apparatus under the present invention.

FIG. 20 is a schematic of an electrophotographic image forming apparatus used for forming an image by a double-component developing process using the toner under the present invention, especially showing a developing portion 31.

A double-component developer is made of a toner 27 (supplied by means of a toner supply roller 28) and a carrier, and is so circulated by means of a stirring roller 29 as to be conveyed to a developer bearing member. An electrostatic latent image is to be developed in a developing zone between the developer bearing member and an electrostatic latent mage bearing member 21 opposed to the developer bearing member, to thereby form a visible toner image on the electrostatic latent mage bearing member 21, followed by transferring of the visible toner image to a transfer member. The above sequential operations are to be carried out once or repeatedly, then one of or a plurality of the visible toner images transferred on the transfer member are fixed to a fixing portion, to thereby prepare a copy image.

On the other hand, after preparing the copy image, the electrostatic latent image bearing member 21 is to be cleaned at a cleaning portion for preparation of the next electrostatic latent image forming.

The developing portion 31 in FIG. 20 is provided with i) the toner supply roller 28 for supplying a toner 27 (in a toner container) to the developing portion 31, ii) the stirring roller 29 for stirring the thus supplied toner 27 with a carrier, iii) a conveying screw 25, iv) a stirring separator 26, v) a doctor 24, and vi) a developing roller 22. The double-component developer made of the toner 27 and the carrier is to be so circulated as to be conveyed to the developer bearing member. The above circulation can be carried out by a rotation of the developing roller 22 alone which is made of a sleeve to which a magnet 23 is fixed and in which the magnet 23 is incorporated. The magnet 23 has repulsive magnetic poles. The doctor 24 may regulate thickness of the developer and a magnetic sensor 30 may controllably sense an apparent permeability change, to thereby supply the toner 27.

Figure 21:
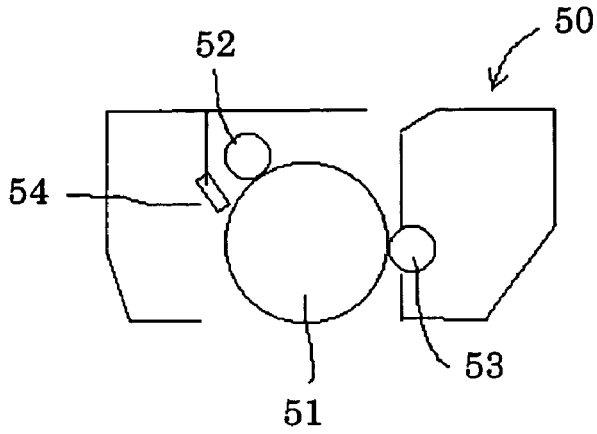
FIG. 21 is a schematic showing an example of a constitution of the image forming apparatus provided with a process cartridge under the present invention.

FIG. 21 is a schematic of an image forming apparatus provided with a process cartridge 50.

FIG. 21 shows the process cartridge 50 (entire part thereof), a photoconductor 51, a charging unit 52, a developing unit 53, and a cleaning unit 54.

Under the present invention, a plurality selected from the constitutional elements including the photoconductor 51, the developing unit 53, the charging unit 52, the cleaning unit 54 are to be integrated with the process cartridge. This integration is to be detachably mounted to the image forming apparatus of a copier, a printer and the like.

In the image forming apparatus having the process cartridge under the present invention, the photoconductor can be rotated at a certain circumferential speed. In the rotation, the charging unit may apply a certain voltage (positive or negative) to a periphery of the photoconductor, then an image exposing unit such as a slit exposure, a laser beam scanning exposure and the like may expose the photoconductor, to thereby form the electrostatic latent images sequentially on the periphery of the photoconductor. The thus formed electrostatic latent images are developed (namely, toner image development) by means of the developing unit. Then, the thus developed toner images are to be sequentially transferred, by means of the transferring unit, to a transfer member which is fed from a paper-feeder to an area between the photoconductor and the transferring unit in synchronization with the rotation of the photoconductor. The transfer member to which the image is thus transferred is separated from a surface of the photoconductor, to be thereafter introduced to an image fixing unit, furthermore, to be printed, as a copy, out of the image forming apparatus. The cleaning unit may remove the toner remaining on the surface of the photoconductor after the above image transferring. Then, the surface of the photoconductor is to be deelectrified, to be used for the subsequent repeated image forming.

Under the present invention, the image forming apparatus and the image forming process using the toner under the present invention can form an electrophotographic image that is so excellent as to be comparable with a silver salt image in fine-line reproducibility, gradation and the like.

Hereinafter described are examples under the present invention. The present invention is, however, not limited thereto.

First Embodiment

EXAMPLE 1

100.0 weight part of polyol resin, 6.0 weight part of quinacridone magenta pigment (C. I. Pigment Red 122) and 2 weight part of salt of zinc salicylate as charging agent were mixed by means of a mixer, and melted-kneaded by an extruder.

The thus obtained kneaded composition having 100 Pa·s of melting viscosity was subjected to a spraying-granulating by using the spraying-granulating apparatus in FIG. 1, to thereby obtain a toner base particle having 5.5 μm of volume average particle diameter and 0.97 of average circularity.

Multisizer (made by Coulter counter) was used for the measurement of the above volume average particle diameter, while a flow-type particle image analyzer FPIA-2100 (made by Sysmex Corporation) was used for the measurement of the circularity.

To the toner base particle, 0.8 weight part of hydrophobic silica and 0.4 weight part of titanium oxide were added, mixing by means of the mixer, followed by removing cohesion by means of a supersonic sifter, to thereby obtain a toner.

Described below are details of the conditions:

Melting unit temperature: 70° C. to 130° C.

Number of spray nozzles: 8 (4 primary intersection collision nozzles, and 4 secondary intersection collision nozzles)

Spray pressure: 0.5 MPa

High pressure gas temperature: 150° C.

Chamber inner temperature: 30° C.

On the other hand, 10.0 weight part of silicone resin solution and 0.7 weight part of carbon black were dispersed by means of a homomixer, to thereby make a coating solution. Then, the coating solution was sprayed (coated) to a surface of 60.0 weight part of magnetite core material by means of a fluidized bed-type coating apparatus formed with a fluidized layer, which layer is formed by i) a centrifugal rotation (caused by a rotary disk) and ii) by a floating fluidity (caused by air flow). After the coating, an electric furnace was used for setting the resin, followed by removing the cohesion by means of a vibratory sifter, to thereby prepare a carrier.

The carrier and the toner were mixed, to thereby prepare a developer having 2.5% of toner density.

The thus prepared developer was subjected to an image test of 50,000 samples by means of an image forming apparatus (modified CX8200 made by Ricoh).

Plain paper was used as a transfer material. A toner image was transferred to the plain paper, with the toner on the plain paper so controlled as to become 0.63 g to 0.68 g per 1 $cm^2$. Then, an elastic roller which is a Si-impregnated rubber roller was used for fixing (heating and pressing) the toner.

The rubber roller has 0.3 mm of thickness, with its surface formed with 30 μm of teflon (trade mark registered) layer.

Hereinafter described are image testing process and evaluation criteria.

<1> A fog was verified by a stain caused to a non-image portion by the toner. "Good" denotes no stain. "Fair" denotes stain found, but practically unproblematical. "Unacceptable" denotes practically problematical.

<2> Resolution was verified in the following manner: To 1 mm width on white paper, copy a manuscript of black fine lines having equidistant gap(s). Verify how many black fine lines are identifiable in the 1 mm width.

<3> Image density was verified in the following manner: By means of a Macbeth densitometer, measure a reflective density of a black solid part of the copied image.

(4) Graininess was verified in the following manner: By means of a scanner (HEIDELBERG Nexscan F4100), measure an image density. Make a calculation according to definitions (equations) of Dooley.

Figure 19:
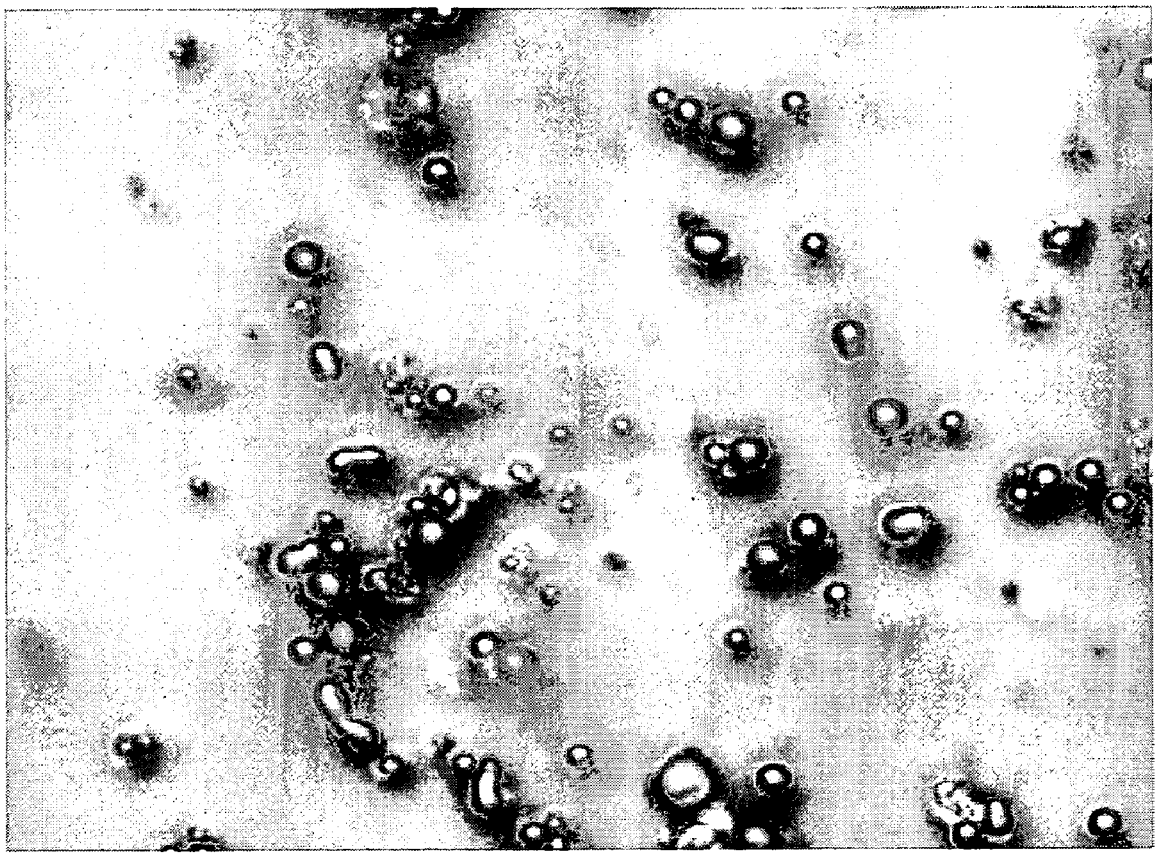
FIG. 19 shows an electrophotography of a granulated particle obtained in an example 1.

Table 1 shows results of the image tests (i.e., image quality) and toner particle distribution according to the first embodiment under the present invention, at the 100th sample and the 50,000th sample. FIG. 19 shows an electrophotography of the granulated particle obtained in the example 1.

EXAMPLE 2

The spraying-granulating apparatus in FIG. 2 was used. The kneaded composition was subjected to a direct spraying-granulating. Then, the materials and the classifying unit like those in the example 1 were used in the example 2, to thereby obtain a toner.

Described below are details of the conditions:

Kneading unit temperature: 50° C. to 150° C.

Number of spray nozzles: 8 (4 primary intersection collision nozzles, and 4 secondary intersection collision nozzles)

Spray pressure: 0.5 MPa

High pressure gas temperature: 150° C.

Chamber inner temperature: 30° C.

The developer thus obtained was used for the image test like that in the example 1, with the result thereof shown in Table 1.

EXAMPLE 3

The example 2 was substantially repeated, except that 1.0 weight % of acetone was added to the raw material, to thereby obtain a toner having 5.6 μm of volume average particle diameter, 0.96 of average circularity, and an irregular particle surface.

The thus obtained developer was subjected to the image test like that in the example 1, with the result thereof shown in Table 1.

EXAMPLE 4

100.0 weight part of polyol resin having 90 Pa·s of melting viscosity was subjected to a spraying-granulating by using the spraying-granulating apparatus in FIG. 1, to thereby obtain a toner base particle having 5.3 μm of volume average particle diameter and 0.98 of average circularity.

Moreover, to the toner base particle, 2.0 weight part of quinacridone magenta pigment (C. I. Pigment Red 122) and 1 weight part of salt of zinc salicylate as charging agent were mixed by means of a high-speed mixer, and were fixed to the surface. Then, 0.8 weight part of hydrophobic silica and 0.4 weight part of titanium oxide were added, mixing by means of the mixer, followed by removing cohesion by means of a supersonic sifter, to thereby obtain a toner having 5.6 μm of volume average particle diameter and 0.96 of average circularity.

Described below are details of the conditions:

Melting unit temperature: 60° C. to 110° C.

Number of spray nozzles: 8 (4 primary intersection collision nozzles, and 4 secondary intersection collision nozzles)

Spray pressure: 0.5 MPa

High pressure gas temperature: 130° C.

Chamber inner temperature: 30° C.

The developer thus obtained was used for the image test like that in the example 1, with the result thereof shown in Table 1.

EXAMPLE 5

The example 1 was substantially repeated, except that the high pressure gas nozzle in FIG. 17 was used, and that 50 kHz of supersonic pulse was generated to the spray nozzle for spraying-granulating.

In this case, the spray pressure was set at 0.4 MPa so as to obtain the toner like that in the example 1, i.e., the toner base particle having 5.5 μm of volume average particle diameter and 0.97 of average circularity.

The developer thus obtained was used for the image test like that in the example 1, with the result thereof shown in Table 1.

EXAMPLE 6

In the conditions of the example 1, inside of the chamber was subjected to a coating of FEP (copolymer of tetrafluoro ethylene-hexafluoro propylene) with $10^5$ Ω·cm of electric resistance and $10^6$ Ω·cm of volume resistance, followed by a spraying-granulating.

In this case, substantially no granulated composition was fixed in the chamber.

The developer thus obtained was used for the image test like that in the example 1, with the result thereof shown in Table 1.

EXAMPLE 7

The spraying-granulating was carried out in the conditions of the example 1. Then, the fine particles were removed by means of a wheel-type mechanical classifying unit, to thereby obtain a toner base particle having 5.7 μm of volume average particle diameter and 5.0 μm of number average particle diameter.

To the toner base particle, 0.8 weight part of hydrophobic silica and 0.4 weight part of titanium oxide were added, mixing by means of a mixer, followed by removing cohesion by means of a supersonic sifter, to thereby obtain a toner.

The developer thus obtained was used for the image test like that in the example 1, with the result thereof shown in Table 1.

EXAMPLE 8

The spraying-granulating was carried out in the conditions of the example 1. Then, an airflow-type cyclone classifying unit was used for fine particle classification, to thereby obtain a toner base particle having 1.5 number % of fine particle (2 μm or less) content and 0.95 of circularity.

To the toner base particle, 0.8 weight part of hydrophobic silica and 0.4 weight part of titanium oxide were added, mixing by means of the mixer, followed by removing cohesion by means of a supersonic sifter, to thereby obtain a toner.

Then, the carrier in the example 1 was used, to thereby obtain a developer having 2.5% of toner density.

The developer thus obtained was used for the image test like that in the example 1, with the result thereof shown in Table 1.

COMPARATIVE EXAMPLE 1

The materials for the example 1 were kneaded by means of an extruder, then were pulverized by means of a fluid layer-type jet into 4.8 μm. Then, a wheel-type mechanical classifying unit was used for two classifying conditions, to thereby obtain a toner having 5.4 μm of volume average particle diameter, 15 number % of fine particle (4.00 μm to 5.04 μm) content, and 0.92 of circularity.

Then, the carrier in the example 1 was used, to thereby obtain a developer having 2.5% of toner density.

The developer thus obtained was used for the image test like that in the example 1, with the result thereof shown in Table 1.

COMPARATIVE EXAMPLE 2

The materials for the example 1 were kneaded by means of an extruder, then were pulverized by means of a fluid layer-type jet into 5.4 μm. Then, an airflow-type cyclone classifying unit was used for classification, to thereby obtain a toner base particle having 1.5 number % of fine particle (2 μm or less) content and 0.91 of circularity.

To the toner base particle, 0.8 weight part of hydrophobic silica and 0.4 weight part of titanium oxide were added, mixing by means of the mixer, followed by removing cohesion by means of a supersonic sifter, to thereby obtain a toner.

Then, the carrier in the example 1 was used, to thereby obtain a developer having 2.5% of toner density.

The developer thus obtained was used for the image test like that in the example 1, with the result thereof shown in Table 1.

TABLE 1

| | | Image quality | | | | Toner's physical property | | *Productivity | |
|---|---|---|---|---|---|---|---|---|---|
| | Sample tested | Reverse transfer | Resolution | Image density | Graininess | Circularity | Volume average particle diameter μm | Energy efficiency kwh/kg | Product recovery % |
| Example 1 | 100th | Good | 7.0 | 1.50 | 0.30 | 0.97 | 5.5 | 6.3 | 85 |
| | 50,000th | Good | 6.9 | 1.46 | 0.31 | | | | |
| Example 2 | 100th | Good | 6.9 | 1.49 | 0.30 | 0.97 | 5.5 | 5.5 | 85 |
| | 50,000th | Good | 6.8 | 1.48 | 0.32 | | | | |
| Example 3 | 100th | Good | 6.9 | 1.48 | 0.34 | 0.96 | 5.6 | 5.5 | 86 |
| | 50,000th | Good | 6.8 | 1.48 | 0.33 | | | | |
| Example 4 | 100th | Fair | 6.7 | 1.47 | 0.41 | 0.98 | 5.3 | 7.5 | 85 |
| | 50,000th | Fair | 6.6 | 1.46 | 0.44 | | | | |
| Example 5 | 100th | Good | 7.0 | 1.49 | 0.30 | 0.97 | 5.5 | 5.8 | 86 |
| | 50,000th | Good | 6.9 | 1.48 | 0.32 | | | | |
| Example 6 | 100th | Good | 6.9 | 1.49 | 0.33 | 0.98 | 5.5 | 6.1 | 88 |
| | 50,000th | Good | 6.8 | 1.49 | 0.34 | | | | |
| Example 7 | 100th | Good | 7.0 | 1.50 | 0.30 | 0.97 | 5.7 | 7.2 | 82 |
| | 50,000th | Good | 6.9 | 1.49 | 0.31 | | | | |
| Example 8 | 100th | Good | 7.0 | 1.50 | 0.30 | 0.97 | 5.5 | 6.4 | 84 |
| | 50,000th | Good | 6.9 | 1.49 | 0.31 | | | | |
| Comparative | 100th | Good | 6.8 | 1.48 | 0.38 | 0.92 | 5.4 | 10.5 | 70 |
| example 1 | 50,000th | Fair | 6.7 | 1.47 | 0.40 | | | | |
| Comparative | 100th | Good | 6.7 | 1.47 | 0.39 | 0.91 | 5.4 | 7.5 | 85 |
| example 2 | 50,000th | Fair | 6.7 | 1.46 | 0.41 | | | | |

*Energy efficiency of productivity denotes a power spent for 1 kg of toner which is obtained at corresponding product recovery.

Second Embodiment

EXAMPLE 9

100.0 weight part of polyol resin, 6.0 weight part of quinacridone magenta pigment (C. I. Pigment Red 122) and 2 weight part of salt of zinc salicylate as charging agent were mixed by means of a mixer, and melted-kneaded by an extruder.

The thus obtained kneaded composition having 120 Pa·s of melting viscosity was added by 1.0 weight % of carbon dioxide in a supercritical state, to thereby decrease the melting viscosity to 100 Pa·s, followed by a spraying-granulating by using the spraying-granulating apparatus in FIG. 3, to thereby obtain a toner base particle having 5.5 μm of volume average particle diameter and 0.97 of average circularity.

Multisizer (made by Coulter counter) was used for the measurement of the above volume average particle diameter, while a flow-type particle image analyzer FPIA-2100 (made by Sysmex Corporation) was used for the measurement of the circularity.

To the toner base particle, 0.8 weight part of hydrophobic silica and 0.4 weight part of titanium oxide were added, mixing by means of the mixer, followed by removing cohesion by means of a supersonic sifter, to thereby obtain a toner.

Described below are details of the conditions:

Melting unit temperature: 70° C. to 130° C.

Number of spray nozzles: 8 (4 primary intersection collision nozzles, and 4 secondary intersection collision nozzles)

Spray pressure: 0.5 MPa

High pressure gas temperature: 150° C.

Chamber inner temperature: 30° C.

On the other hand, 10.0 weight part of silicone resin solution and 0.7 weight part of carbon black were dispersed by means of a homomixer, to thereby make a coating solution. Then, the coating solution was sprayed (coated) to a surface of 60.0 weight part of magnetite core material by means of a fluidized bed-type coating apparatus formed with a fluidized layer, which layer is formed by i) a centrifugal rotation (caused by a rotary disk) and ii) by a floating fluidity (caused by air flow). After the coating, an electric furnace was used for setting the resin, followed by removing the cohesion by means of a vibratory sifter, to thereby prepare a carrier.

The carrier and the toner were mixed, to thereby prepare a developer having 2.5% of toner density.

The thus prepared developer was subjected to an image test of 50,000 samples by means of an image forming apparatus (modified CX8200 made by Ricoh).

Plain paper was used as a transfer material. A toner image was transferred to the plain paper, with the toner on the plain paper so controlled as to become 0.63 g to 0.68 g per 1 $cm^2$. Then, an elastic roller which is a Si-impregnated rubber roller was used for fixing (heating and pressing) the toner.

The rubber roller has 0.3 mm of thickness, with its surface formed with 30 μm of teflon (trade mark registered) layer.

Hereinafter described are image testing process and evaluation criteria.

<1> A fog was verified by a stain caused to a non-image portion by the toner. "Good" denotes no stain. "Fair" denotes stain found, but practically unproblematical. "Unacceptable" denotes practically problematical.

<2> Resolution was verified in the following manner: To 1 mm width on white paper, copy a manuscript of black fine lines having equidistant gap(s). Verify how many black fine lines are identifiable in the 1 mm width.

<3> Image density was verified in the following manner: By means of a Macbeth densitometer, measure a reflective density of a black solid part of the copied image.

<4> Graininess was verified in the following manner: By means of a scanner (HEIDELBERG Nexscan F4100), measure an image density. Make a calculation according to definitions (equations) of Dooley.

Table 2 shows results of the image tests (i.e., image quality) and toner particle distribution according to the second embodiment under the present invention, at the 100th sample and the 50,000th sample.

EXAMPLE 10

The spraying-granulating apparatus in FIG. 4 was used. The kneaded composition was added by 1.0 weight % of carbon dioxide in a supercritical state, followed by a direct spraying-granulating. Then, the materials and the classifying unit like those in the example 9 were used in the example 10, to thereby obtain a toner.

Described below are details of the conditions:

Kneading unit temperature: 50° C. to 150° C.

Number of spray nozzles: 8 (4 primary intersection collision nozzles, and 4 secondary intersection collision nozzles)

Spray pressure: 0.5 MPa

High pressure gas temperature: 150° C.

Chamber inner temperature: 30° C.

The developer thus obtained was used for the image test like that in the example 9, with the result thereof shown in Table 2.

EXAMPLE 11

The example 10 was substantially repeated, except that 1.0 weight % of acetone was added to the raw material, to thereby obtain a toner having 5.6 μm of volume average particle diameter, 0.96 of average circularity, and an irregular particle surface.

The thus obtained developer was subjected to the image test like that in the example 9, with the result thereof shown in Table 2.

EXAMPLE 12

100.0 weight part of polyol resin having 110 Pa·s of melting viscosity by the melting unit in FIG. 3 was added by 1.0 weight % of carbon dioxide in a supercritical state, to thereby decrease the melting viscosity to 90 Pa·s, followed by a spraying-granulating, to thereby obtain a toner base particle having 5.3 μm of volume average particle diameter and 0.98 of average circularity.

Moreover, to the toner base particle, 2.0 weight part of quinacridone magenta pigment (C. I. Pigment Red 122) and 1 weight part of salt of zinc salicylate as charging agent were mixed by means of a high-speed mixer, and were fixed to the surface. Then, 0.8 weight part of hydrophobic silica and 0.4 weight part of titanium oxide were added, mixing by means of the mixer, followed by removing cohesion by means of a supersonic sifter, to thereby obtain a toner having 5.6 μm of volume average particle diameter and 0.96 of average circularity.

Described below are details of the conditions:

Melting unit temperature: 60° C. to 110° C.

Number of spray nozzles: 8 (4 primary intersection collision nozzles, and 4 secondary intersection collision nozzles)

Spray pressure: 0.5 MPa

High pressure gas temperature: 130° C.

Chamber inner temperature: 30° C.

The developer thus obtained was used for the image test like that in the example 9, with the result thereof shown in Table 2.

EXAMPLE 13

The example 9 was substantially repeated, except that the high pressure gas nozzle in FIG. 17 was used, and that 50 kHz of supersonic pulse was generated to the spray nozzle for spraying-granulating.

In this case, the spray pressure was set at 0.4 MPa so as to obtain the toner like that in the example 9, i.e., the toner base particle having 5.5 μm of volume average particle diameter and 0.97 of average circularity.

The developer thus obtained was used for the image test like that in the example 9, with the result thereof shown in Table 2.

EXAMPLE 14

In the conditions of the example 9, inside of the chamber was subjected to a coating of FEP (copolymer of tetrafluoro ethylene-hexafluoro propylene) with $10^6$ Ω·cm of electric resistance and $10^6$ Ω·cm of volume resistance, followed by a spraying-granulating.

In this case, substantially no granulated composition was fixed in the chamber.

The developer thus obtained was used for the image test like that in the example 9, with the result thereof shown in Table 2.

EXAMPLE 15

The supercritical fluid spraying-granulating was carried out in the conditions of the example 9. Then, the fine particles were removed by means of a wheel-type mechanical classifying unit, to thereby obtain a toner base particle having 5.7 μm of volume average particle diameter and 5.0 μm of number average particle diameter.

To the toner base particle, 0.8 weight part of hydrophobic silica and 0.4 weight part of titanium oxide were added, mixing by means of a mixer, followed by removing cohesion by means of a supersonic sifter, to thereby obtain a toner.

The developer thus obtained was used for the image test like that in the example 9, with the result thereof shown in Table 2.

EXAMPLE 16

The supercritical fluid spraying-granulating was carried out in the conditions of the example 9. Then, an airflow-type cyclone classifying unit was used for fine particle classification, to thereby obtain a toner base particle having 1.5 number % of fine particle (2 μm or less) content and 0.95 of circularity.

To the toner base particle, 0.8 weight part of hydrophobic silica and 0.4 weight part of titanium oxide were added, mixing by means of the mixer, followed by removing cohesion by means of a supersonic sifter, to thereby obtain a toner.

Then, the carrier in the example 9 was used, to thereby obtain a developer having 2.5% of toner density.

The developer thus obtained was used for the image test like that in the example 9, with the result thereof shown in Table 2.

COMPARATIVE EXAMPLE 3

The materials for the example 9 were kneaded by means of an extruder, then were pulverized by means of a fluid layer-type jet into 4.8 μm. Then, a wheel-type mechanical classifying unit was used for two classifying conditions, to thereby obtain a toner having 5.4 μm of volume average particle diameter, 15 number % of fine particle (4.00 μm to 5.04 μm) content, and 0.92 of circularity.

Then, the carrier in the example 9 was used, to thereby obtain a developer having 2.5% of toner density.

The developer thus obtained was used for the image test like that in the example 9, with the result thereof shown in Table 2.

COMPARATIVE EXAMPLE 4

The materials for the example 9 were kneaded by means of an extruder, then were pulverized by means of a fluid layer-type jet into 5.4 μm. Then, an airflow-type cyclone classifying unit was used for classification, to thereby obtain a toner base particle having 1.5 number % of fine particle (2 μm or less) content and 0.91 of circularity.

To the toner base particle, 0.8 weight part of hydrophobic silica and 0.4 weight part of titanium oxide were added, mixing by means of the mixer, followed by removing cohesion by means of a supersonic sifter, to thereby obtain a toner.

Then, the carrier in the example 9 was used, to thereby obtain a developer having 2.5% of toner density.

The developer thus obtained was used for the image test like that in the example 9, with the result thereof shown in Table 2.

COMPARATIVE EXAMPLE 5

The material in the example 9 having 100 Pa·s of melting viscosity by the melting unit was subjected to a spraying-granulating, to thereby obtain a toner base particle having 5.5 μm of volume average particle diameter and 0.97 of average circularity.

To the toner base particle, 0.8 weight part of hydrophobic silica and 0.4 weight part of titanium oxide were added, mixing by means of a mixer, followed by removing cohesion by means of a supersonic sifter, to thereby obtain a toner.

On the other hand, 10.0 weight part of silicone resin solution and 0.7 weight part of carbon black were dispersed by means of a homomixer, to thereby make a coating solution. Then, the coating solution was sprayed (coated) to a surface of 60.0 weight part of magnetite core material by means of a fluidized bed-type coating apparatus formed with a fluidized layer, which layer is formed by i) a centrifugal rotation (caused by a rotary disk) and ii) by a floating fluidity (caused by air flow).

After the coating, an electric furnace was used for setting the resin, followed by removing the cohesion by means of a vibratory sifter, to thereby prepare a carrier.

The carrier and the toner were mixed, to thereby prepare a developer having 2.5% of toner density.

The developer thus obtained was used for the image test like that in the example 9, with the result thereof shown in Table 2.

TABLE 2

| | | Image quality | | | | Toner's physical property | | *Productivity | |
|---|---|---|---|---|---|---|---|---|---|
| | Sample tested | Reverse transfer | Resolution | Image density | Graininess | Circularity | Volume average particle diameter μm | Energy efficiency kwh/kg | Product recovery % |
| Example 9 | 100th | Good | 7.0 | 1.50 | 0.30 | 0.98 | 5.5 | 6.0 | 88 |
| | 50,000th | Good | 6.9 | 1.48 | 0.31 | | | | |
| Example 10 | 100th | Good | 6.9 | 1.49 | 0.30 | 0.97 | 5.5 | 5.2 | 89 |
| | 50,000th | Good | 6.9 | 1.48 | 0.31 | | | | |
| Example 11 | 100th | Good | 6.9 | 1.48 | 0.33 | 0.97 | 5.6 | 5.2 | 89 |
| | 50,000th | Good | 6.8 | 1.48 | 0.33 | | | | |
| Example 12 | 100th | Fair | 6.7 | 1.47 | 0.40 | 0.98 | 5.3 | 7.2 | 88 |
| | 50,000th | Fair | 6.6 | 1.46 | 0.42 | | | | |
| Example 13 | 100th | Good | 7.0 | 1.49 | 0.30 | 0.98 | 5.5 | 5.5 | 89 |
| | 50,000th | Good | 6.9 | 1.49 | 0.32 | | | | |
| Example 14 | 100th | Good | 6.9 | 1.49 | 0.33 | 0.98 | 5.5 | 5.8 | 90 |
| | 50,000th | Good | 6.8 | 1.49 | 0.33 | | | | |
| Example 15 | 100th | Good | 7.0 | 1.50 | 0.30 | 0.97 | 5.6 | 6.7 | 86 |
| | 50,000th | Good | 6.9 | 1.49 | 0.31 | | | | |
| Example 16 | 100th | Good | 4.0 | 1.50 | 0.30 | 0.97 | 5.5 | 6.1 | 87 |
| | 50,000th | Good | 6.9 | 1.49 | 0.30 | | | | |
| Comparative example 3 | 100th | Good | 6.8 | 1.48 | 0.38 | 0.92 | 5.4 | 10.5 | 70 |
| | 50,000th | Fair | 6.7 | 1.47 | 0.40 | | | | |
| Comparative example 4 | 100th | Good | 6.7 | 1.47 | 0.39 | 0.91 | 5.4 | 7.5 | 85 |
| | 50,000th | Fair | 6.7 | 1.46 | 0.41 | | | | |
| Comparative example 5 | 100th | Good | 7.0 | 1.50 | 0.30 | 0.97 | 5.5 | 6.3 | 85 |
| | 50,000th | Good | 6.9 | 1.46 | 0.31 | | | | |

*Energy efficiency of productivity denotes a power spent for 1 kg of toner which is obtained at corresponding product recovery.

From the results in Table 1 and Table 2, and as compared with the conventional kneading-pulverizing processes, the following can be described.

The spraying-granulating used for the first embodiment (example 1 to example 8) of the toner manufacturing process under the present invention can obtain a toner that has higher productivity, lower energy consumption, and higher circularity with small particle diameter. The thus obtained toner can form an image that brings about density and luminosity having a small variation, thereby bringing about a high quality image.

Moreover, the spraying-granulating used for the second embodiment (example 9 to example 16) of the toner manufacturing process under the present invention, which second embodiment using the supercritical fluid injection, as compared with the first embodiment (example 1 to example 8), can bring about the following effect: <1> the supercriticality can spray the toner at a temperature (for kneading or melting) lower than the process without the supercriticality, specifically the temperature is 5° C. to 20° C. lower, <2> the energy efficiency can be more improved in view of productivity (namely, a smaller energy can obtain the granulated composition), and <3> a lower spraying temperature can reduce cohesions, thus improving product recovery, and <4> further improvement is made in image quality, toner's physical property and the like.

What is claimed is:

1. A toner manufacturing process, comprising:

kneading a mixed composition, to thereby obtain a kneaded composition; and spraying the kneaded composition with a high pressure gas from a high pressure nozzle having a plurality of spray nozzles, to thereby form a fine particle, wherein at least one residing zone is formed on a side surface of the plurality of spray nozzles, the at least one residing zone is configured to allow some of the gas flowing through the nozzle to temporarily reside therein before being ejected from the spray nozzle, wherein the high pressure gas has undergone intersection collisions, wherein the mixed composition is selected from the group consisting of the following <1>, <2>and <3>:

<1> a first mixed composition comprising a binder resin, a colorant, and a charge controlling agent, <2> a second mixed composition comprising a binder resin, a colorant, a charge controlling agent, and a releasing agent, <3> a third mixed composition comprising a binder resin, a magnetic agent, a charge controlling agent, and a releasing agent, and wherein the high pressure nozzle has a vibrator causing a vibrational force of 500 N to 8000 N to the high pressure nozzle, with a frequency of 0.55 kHz to 2.00 kHz.

2. The toner manufacturing process according to claim 1, wherein the toner manufacturing process uses:

a kneading unit configured to knead the mixed composition, and a spraying-granulating apparatus comprising a chamber equipped with the high pressure nozzle causing the high pressure gas, and the kneaded composition being ejected into the chamber is sprayed with the high pressure gas from the high pressure nozzle.

3. The toner manufacturing process according to claim 1, wherein a supersonic pulse of 10 kHz to 80 kHz is caused to the high pressure gas, to thereby carry out the spraying-granulating.

* * * * *